US012716588B1

(12) United States Patent
Hughes et al.

(10) Patent No.: US 12,716,588 B1
(45) Date of Patent: Aug. 25, 2026

(54) FUEL NOZZLE ASSEMBLY FOR TURBOMACHINE

(71) Applicant: GE Vernova Infrastructure Technology LLC, Greenville, SC (US)

(72) Inventors: Michael John Hughes, State College, PA (US); Johnie Franklin McConnaughhay, Greenville, SC (US); Tyler Walton Kasperski, Greenville, SC (US); Elizabeth Grace Hildebrand, Greenville, SC (US)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/199,929

(22) Filed: May 6, 2025

(51) Int. Cl.
*F23R 3/28* (2006.01)

(52) U.S. Cl.
CPC ..... *F23R 3/28* (2013.01)

(58) Field of Classification Search
CPC .. F23R 3/286; F23R 3/283; F23R 3/28; F23R 3/10; F23R 3/32; F23R 3/002; F02C 7/222; F02C 7/22
See application file for complete search history.

(56) References Cited

U.S. PATENT DOCUMENTS 4,112,676 A 9/1978 DeCorso
4,408,461 A * 10/1983 Bruhwiler ..... F23R 3/286 60/737
5,289,686 A 3/1994 Razdan et al.
5,797,268 A * 8/1998 Ryan ..... F23R 3/14 60/747
6,298,667 B1 * 10/2001 Glynn ..... F23R 3/002 60/737
7,137,256 B1 11/2006 Stuttaford et al.
8,112,216 B2 2/2012 Davis, Jr. et al.
8,205,452 B2 * 6/2012 Boardman ..... F23R 3/283 60/737
8,984,888 B2 3/2015 Uhm et al.
(Continued)

FOREIGN PATENT DOCUMENTS

EP 2865981 B1 4/2015
EP 3406974 A1 11/2018
(Continued)

OTHER PUBLICATIONS

Co-Pending U.S. Appl. No. 18/401,568, filed Dec. 31, 2023.
(Continued)

*Primary Examiner* — Craig Kim
(74) *Attorney, Agent, or Firm* — Dority & Manning, P.A.

(57) ABSTRACT

A bundled tube fuel nozzle is provided. The bundled tube fuel nozzle includes a body defining a fuel plenum and including a forward plate at least partially defining the fuel plenum, a plurality of tubes extending axially through the fuel plenum, and an aft plate axially spaced from the forward plate. Each tube of the plurality of tubes has an inlet defined through the forward plate, and the aft plate includes a downstream face having a plurality of tiles. Each tile of the plurality of tiles extends radially outward from one or more tubes of the plurality of tubes. The aft plate defines a plurality of peripheral openings between the plurality of tiles to permit a cooling flow therethrough from an upstream side of the aft plate to a downstream side of the aft plate.

20 Claims, 14 Drawing Sheets

(56) References Cited

U.S. PATENT DOCUMENTS

| | | | | |
|---|---|---|---|---|
| 9,121,612 | B2 * | 9/2015 | Uhm | F23R 3/286 |
| 9,130,198 | B2 | 9/2015 | Visco et al. | |
| 9,366,439 | B2 * | 6/2016 | Melton | F23R 3/283 |
| 9,752,835 | B2 | 9/2017 | Waldman et al. | |
| 9,764,435 | B2 | 9/2017 | Morris et al. | |
| 9,808,864 | B2 | 11/2017 | Kawada et al. | |
| 9,945,562 | B2 | 4/2018 | Hughes et al. | |
| 10,041,680 | B2 * | 8/2018 | Asai | F23R 3/343 |
| 10,087,844 | B2 * | 10/2018 | Hughes | F23D 14/64 |
| 10,145,561 | B2 * | 12/2018 | Stoia | F02C 3/04 |
| 10,254,499 | B1 | 4/2019 | Cohen et al. | |
| 10,344,982 | B2 * | 7/2019 | Berry | F23R 3/28 |
| 10,544,941 | B2 * | 1/2020 | Stoia | F23R 3/286 |
| 10,551,058 | B2 * | 2/2020 | Lang, Sr. | F27B 1/10 |
| 10,563,869 | B2 | 2/2020 | Berry et al. | |
| 10,744,561 | B2 | 8/2020 | Yoshimura | |
| 11,300,052 | B2 * | 4/2022 | Muruganandam | F23R 3/28 |
| 11,525,578 | B2 * | 12/2022 | Natarajan | F23R 3/46 |
| 12,050,062 | B2 | 7/2024 | Berry et al. | |
| 2003/0051478 | A1 | 3/2003 | Matsuyama et al. | |
| 2008/0245072 | A1 | 10/2008 | Maeding | |
| 2009/0071157 | A1 | 3/2009 | Cai | |
| 2010/0174466 | A1 | 7/2010 | Davis, Jr. et al. | |
| 2010/0218501 | A1 * | 9/2010 | York | F23D 14/02 60/737 |
| 2010/0300106 | A1 * | 12/2010 | Edwards | F23R 3/10 60/752 |
| 2011/0197587 | A1 | 8/2011 | Zuo et al. | |
| 2013/0084534 | A1 * | 4/2013 | Melton | F23R 3/10 431/2 |
| 2013/0122438 | A1 | 5/2013 | Stoia et al. | |
| 2013/0299602 | A1 | 11/2013 | Hughes et al. | |
| 2013/0318977 | A1 | 12/2013 | Berry et al. | |
| 2014/0013756 | A1 | 1/2014 | Melton et al. | |
| 2014/0053571 | A1 * | 2/2014 | Keener | F23R 3/283 60/782 |
| 2014/0061327 | A1 | 3/2014 | Hughes | |
| 2014/0109591 | A1 | 4/2014 | Bothien et al. | |
| 2014/0174090 | A1 | 6/2014 | Chen et al. | |
| 2014/0260270 | A1 | 9/2014 | Graham et al. | |
| 2014/0260315 | A1 * | 9/2014 | Westmoreland | F23R 3/286 60/737 |
| 2014/0338355 | A1 | 11/2014 | Stewart et al. | |
| 2015/0000286 | A1 * | 1/2015 | LeBegue | F23R 3/286 60/742 |
| 2015/0219338 | A1 | 8/2015 | Dai et al. | |
| 2015/0241064 | A1 * | 8/2015 | Boardman | F23R 3/10 60/737 |
| 2016/0081469 | A1 | 3/2016 | Undesser | |
| 2016/0123596 | A1 | 5/2016 | Hoke et al. | |
| 2016/0146469 | A1 * | 5/2016 | Lum | F23R 3/286 60/737 |
| 2016/0361873 | A1 | 12/2016 | Maier | |
| 2017/0176014 | A1 | 6/2017 | Hughes et al. | |
| 2018/0066847 | A1 | 3/2018 | Stoia et al. | |
| 2018/0112875 | A1 | 4/2018 | Daniel | |
| 2018/0156128 | A1 | 6/2018 | Imfeld et al. | |
| 2018/0172273 | A1 | 6/2018 | Purcell et al. | |
| 2018/0187603 | A1 * | 7/2018 | Berry | F23R 3/32 |
| 2018/0363907 | A1 * | 12/2018 | Purcell | F23R 3/286 |
| 2019/0056112 | A1 | 2/2019 | Natarajan et al. | |
| 2021/0199299 | A1 | 7/2021 | Berry et al. | |
| 2021/0301722 | A1 * | 9/2021 | Ziminsky | F23R 3/346 |
| 2023/0022725 | A1 | 1/2023 | Fukuba et al. | |
| 2023/0135396 | A1 | 5/2023 | Kalb et al. | |
| 2024/0060644 | A1 | 2/2024 | Hellat et al. | |
| 2024/0230098 | A1 * | 7/2024 | Berry | F23R 3/002 |

FOREIGN PATENT DOCUMENTS

| | | | | |
|---|---|---|---|---|
| EP | 3889508 | A1 * | 10/2021 | F23R 3/42 |
| JP | 5841649 | B1 | 1/2016 | |
| KR | 20150074155 | A | 7/2015 | |

OTHER PUBLICATIONS

Co-Pending U.S. Appl. No. 18/401,579, filed Dec. 31, 2023.
Co-Pending U.S. Appl. No. 18/401,576, filed Dec. 31, 2023.
Co-Pending U.S. Appl. No. 18/401,588 filed, Dec. 31, 2023.
Co-Pending U.S. Appl. No. 18/401,584, filed Dec. 31, 2023.
Co-Pending U.S. Appl. No. 18/401,585, filed Dec. 31, 2023.
Co-Pending U.S. Appl. No. 18/401,572, filed Dec. 31, 2023.

* cited by examiner

FUEL NOZZLE ASSEMBLY FOR TURBOMACHINE

FIELD

The present disclosure relates generally to gas turbine combustors and, more particularly, to fuel nozzle assemblies associated with such combustors.

BACKGROUND

Turbomachines are utilized in a variety of industries and applications for energy transfer purposes. For example, a gas turbine engine generally includes a compressor section, a combustion section, a turbine section (e.g., an expansion turbine), and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

In some combustors, the generation of combustion gases occurs at two axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone.

Some gas turbine engines include fuel nozzles having an aft plate that defines an upstream boundary of the combustion chamber. A downstream side of the aft plate facing the combustion section gets hotter than an upstream side of the aft plate facing away from the combustion section (where upstream and downstream directions are defined according to the flow of fluids through the fuel nozzles and into the combustion chamber). Accordingly, under certain conditions, the downstream side of the aft face may expand due to thermal stresses and cause bowing or cracking of the aft plate. In combustors where the fuel nozzles are coupled to or integral with the aft plate, the distortion of the aft plate can cause significant thermal stresses within the fuel nozzles.

As such, turbomachines, combustors, and fuel nozzles capable of delivering fuel and air for combustion while reducing thermal stresses and combustion dynamics are desired in the art.

BRIEF DESCRIPTION

Aspects and advantages of the turbomachines, combustors, and fuel nozzles in accordance with the present disclosure will be set forth in part in the following description, or may be obvious from the description, or may be learned through practice of the technology.

In accordance with one embodiment, a bundled tube fuel nozzle is provided. The bundled tube fuel nozzle includes a body defining a fuel plenum and including a forward plate at least partially defining the fuel plenum, a plurality of tubes extending axially through the fuel plenum, and an aft plate axially spaced from the forward plate. Each tube of the plurality of tubes has an inlet defined through the forward plate, and the aft plate includes a downstream face having a plurality of tiles. Each tile of the plurality of tiles extends radially outward from one or more tubes of the plurality of tubes. The aft plate defines a plurality of peripheral openings between the plurality of tiles to permit a cooling flow therethrough from an upstream side of the aft plate to a downstream side of the aft plate.

In accordance with another embodiment, a combustor for a gas turbine engine is provided. The combustor includes a body defining a fuel plenum and including a forward plate and an aft plate at least partially defining the fuel plenum, a plurality of tubes extending axially through the fuel plenum, and an air plenum downstream of the fuel plenum. Each tube of the plurality of tubes has an inlet defined through the forward plate, and the air plenum is at least partially defined between an upstream face and a downstream face of the aft plate. The downstream face of the aft plate comprises a plurality of tiles. Each tile of the plurality of tiles extends radially outward from one or more tubes of the plurality of tubes. The aft plate defines a plurality of peripheral openings between the plurality of tiles to permit a cooling flow therethrough from an upstream face of the aft plate to a downstream face of the aft plate. The cooling flow is directed onto an inner surface of the downstream face of the aft plate and through the plurality of peripheral openings.

These and other features, aspects and advantages of the present turbomachines, combustors, and fuel nozzles will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present turbomachines, combustors, and fuel nozzles, including the best mode of making and using the present systems and methods, directed to one of ordinary skill in the art, is set forth in the specification, which makes reference to the appended figures, in which.

DETAILED DESCRIPTION

Figure 1:
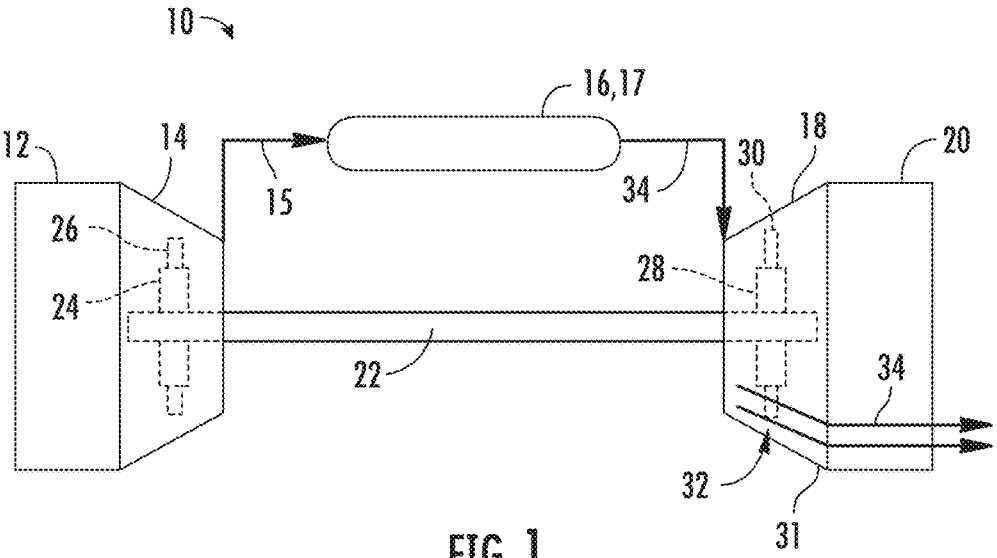
FIG. 1 is a schematic illustration of a turbomachine, in accordance with embodiments of the present disclosure.

Reference now will be made in detail to embodiments of the present turbomachines, combustors, and fuel nozzles, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the subject technology. As used herein, the terms "first," "second," and "third" may be used interchangeably to distinguish one component from another and are not intended to signify location or importance of the individual components.

The term "fluid" may refer to a gas or a liquid. The term "fluid communication" means that a fluid is capable of flowing or being conveyed between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component; the term "axially" refers to the relative direction that is substantially parallel and/or coaxially aligned to an axial centerline of a particular component; and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values, and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled," "directly fixed," "directly attached to," and the like indicate that a first component is joined to a second component with no intervening structures. Additive manufacturing is an example of direct coupling.

As used herein, the terms "comprises," "comprising." "includes," "including." "has." "having" or any other variations thereof, are intended to cover a non-exclusive inclusion. For example, a process, method, article, or apparatus that comprises a list of features is not necessarily limited only to those features but may include other features not expressly listed or inherent to such process, method, article, or apparatus.

Here and throughout the specification and claims, range limitations are identified and include all the sub-ranges contained therein unless context or language indicates otherwise. For example, all ranges disclosed herein are inclusive of the endpoints, and the endpoints are independently combinable with each other.

As used herein, the term "premix" may be used to describe a component, passage, or cavity upstream of a respective combustion zone within which mixing of fluids occurs. For example, "premix" may be used to describe a component, passage, or cavity in which two or more fluids (such as fuel and air) are mixed together prior to being ejected from such component, passage, or cavity (e.g., into a combustion zone).

Referring now to the drawings, FIG. 1 illustrates a schematic diagram of an example embodiment of a turbomachine, which in the illustrated embodiment is a gas turbine engine 10. Although an industrial or land-based gas turbine is shown and described herein, the present disclosure is not limited to an industrial or land-based gas turbine engine unless otherwise specified in the claims. For example, the technology as described herein may be used in any type of turbomachine including but not limited to a steam turbine, an aircraft gas turbine, or a marine gas turbine.

As shown, gas turbine engine 10 generally includes an inlet section 12, a compressor section 14 disposed downstream of the inlet section 12, a plurality of combustors 17 (shown in FIG. 2) within a combustion section 16 disposed downstream of the compressor section 14, a turbine section 18 disposed downstream of the combustion section 16, and an exhaust section 20 disposed downstream of the turbine section 18. Additionally, the gas turbine engine 10 may include one or more shafts 22 coupled between the compressor section 14 and the turbine section 18. The shaft 22 may be coupled to a generator, not shown, for producing electricity.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14. The compressor section 14 further includes a plurality of stationary vanes (not shown), which are arranged in stages with the rotor blades 26 and which direct the flow against the rotor blades 26.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18. The turbine section 18 further includes a plurality of stationary vanes (not shown), which are arranged in stages with the rotor blades 30 and which direct the flow against the rotor blades 30.

During operation, a working fluid such as air flows through the inlet section 12 and into the compressor section 14 where the air is progressively compressed by multiple compressor stages of rotating blades and stationary vanes, thus providing pressurized air 15 to the combustors 17 of the combustion section 16. The pressurized air 15 is mixed with fuel and burned within each combustor 17 to produce combustion gases 34. The combustion gases 34 flow through the hot gas path 32 from the combustion section 16 into the turbine section 18, in which energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine engine 10 via the exhaust section 20.

Figure 2:
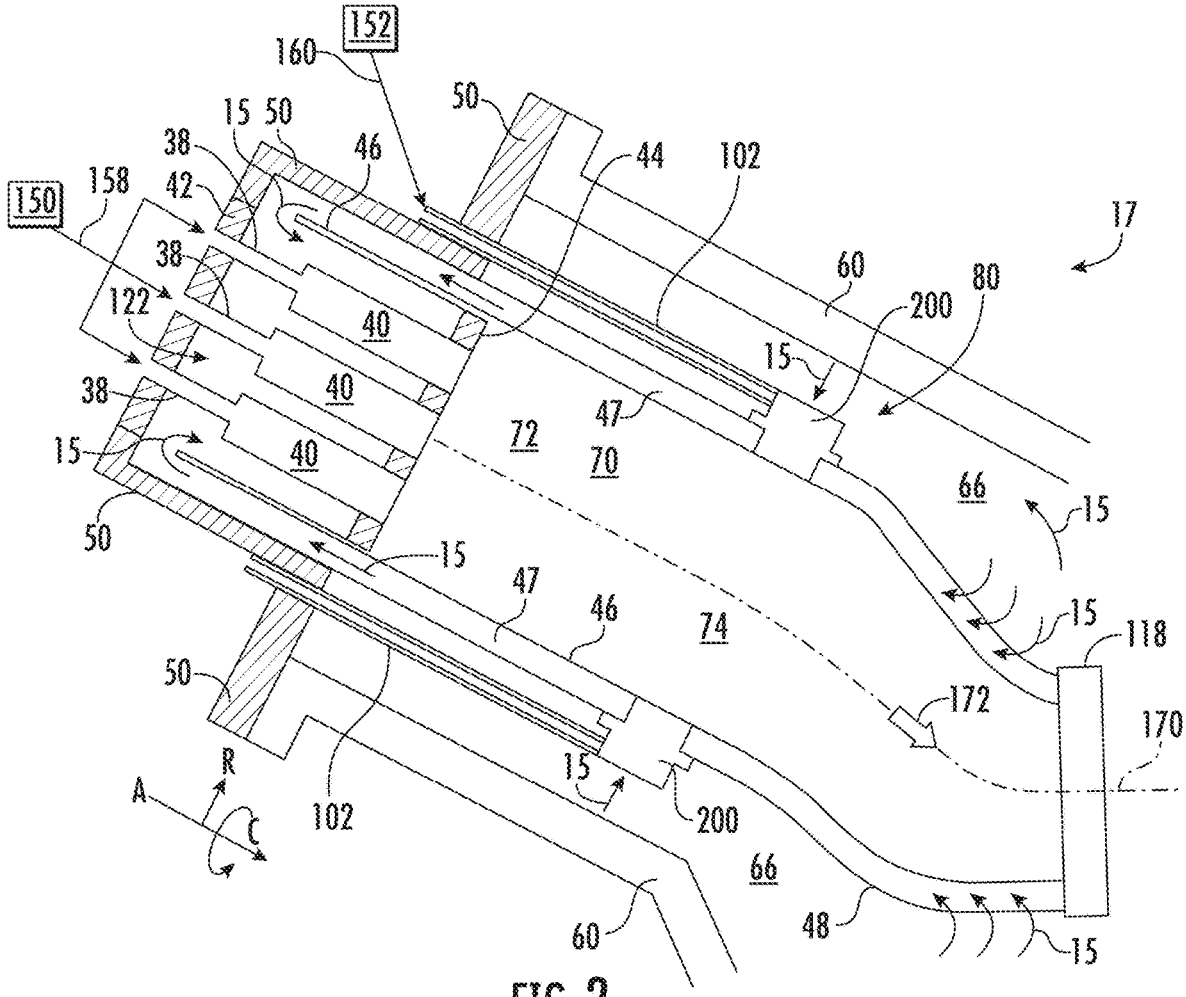
FIG. 2 is a schematic view of a combustor as may be employed in the turbomachine of FIG. 1, in accordance with embodiments of the present disclosure.

FIG. 2 is a schematic representation of a combustor 17, as may be included in the combustion section 16, which may be a can annular combustion system, for the gas turbine engine 10. In a can annular combustion system, a plurality of combustors 17 (e.g., 8, 10, 12, 14, 16, or more) are positioned in an annular array about the shaft 22 that connects the compressor section 14 to the turbine section 18.

As shown in FIG. 2, the combustor 17 may define a cylindrical coordinate system. The cylindrical coordinate system may define an axial direction A (e.g., downstream direction) substantially parallel to and/or along an axial centerline 170 of the combustor 17, a radial direction R perpendicular to the axial centerline 170, and a circumferential direction C extending around the axial centerline 170.

As shown in FIG. 2, the combustor 17 includes a combustion liner 46 that defines a combustion chamber 70. The combustion liner 46 may be positioned within (i.e., circumferentially surrounded by) an outer sleeve 48, such that an annulus 47 is formed therebetween. The combustion liner 46 may contain and convey combustion gases to the turbine section 18. The combustion liner 46 defines the combustion chamber 70 within which combustion occurs. As shown in FIG. 2, the combustion liner 46 may extend between fuel nozzles 40 and an aft frame 118. The combustion liner 46 may have a generally cylindrical liner portion and a tapered transition portion that is separate from the generally cylindrical liner portion, as in many conventional combustion systems. Alternately, the combustion liner 46 may have a unified body (or "unibody") construction, in which the generally cylindrical portion and the tapered portion are integrated with one another. Thus, any discussion of the combustion liner 46 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine section 18 are integrated into a single unit, sometimes referred to as a "transition nozzle" or an "integrated exit piece."

FIG. 2 illustrates a combustor 17 having both fuel nozzles 40 and one or more fuel injection assemblies 80 (also referred to as an axial fuel staging (AFS) system). The fuel nozzles 40 may be positioned at the forward end of the combustor 17. Fuel may be directed through fuel supply conduits 38, which extend through an end cover 42, and into the fuel nozzles 40. The fuel nozzles 40 convey the fuel and pressurized air 15 into a primary combustion zone 72, where combustion occurs. In some embodiments, the fuel and pressurized air 15 are combined as a mixture prior to reaching the primary combustion zone 72.

The combustion liner 46 may be surrounded by an outer sleeve 48, which is spaced radially outward of the combustion liner 46 to define an annulus 47 through which pressurized air 15 flows to a head end of the combustor 17. For example, pressurized air 15 may enter the annulus 47 through the outer sleeve 48 (e.g., through impingement holes proximate to the aft frame 118) and travel towards the end cover 42, such that the pressurized air 15 within the annulus 47 flows opposite the direction of combustion gases 172 (34 in FIG. 1) within the combustion liner 46. Heat is transferred convectively from the combustion liner 46 to the pressurized air 15, thus cooling the combustion liner 46 and warming the pressurized air 15.

In some embodiments, the outer sleeve 48 may include a flow sleeve and an impingement sleeve coupled to one another. The flow sleeve may be disposed at the forward end, and the impingement sleeve may be disposed at the aft end. Alternately, the outer sleeve 48 may have a unified body (or "unisleeve") construction, in which the flow sleeve and the impingement sleeve are integrated with one another in the axial direction. As before, any discussion of the outer sleeve 48 herein is intended to encompass both conventional combustion systems having a separate flow sleeve and impingement sleeve and combustion systems having a unisleeve outer sleeve.

The forward casing 50 and the end cover 42 of the combustor 17 define a head end air plenum 122, which includes the one or more fuel nozzles 40. The fuel nozzles 40 are bundled tube fuel nozzles (often referred to as "micromixers") constructed to span the entire boundary of the primary combustion zone 72, although one or more swirler nozzles (often referred to as "swozzles") may be incorporated into the combustor 17 (e.g., as a center nozzle). The fuel nozzles 40 may be positioned within the head end air plenum 122 defined at least partially by the forward casing 50. In many embodiments, the fuel nozzles 40 may extend from the end cover 42. For example, each fuel nozzle 40 may be coupled to an aft surface of the end cover 42 via a flange (not shown). As shown in FIG. 2, the fuel nozzles 40 may be partially surrounded by the combustion liner 46 or a perforated cylindrical barrel (not shown) that functions to condition the air flow 15 entering the fuel nozzles 40. The aft, or downstream ends, of the fuel nozzles 40 extend through or collectively define a cap plate 44 that defines the upstream end of the combustion chamber 70.

The fuel nozzles 40 may be in fluid communication with a first fuel supply 150 configured to supply a first fuel 158 to the fuel nozzles 40. In many embodiments, the first fuel 158 may be a fuel mixture containing natural gas (such as methane, ethane, propane, or other suitable natural gas) and/or hydrogen. In other embodiments, the first fuel 158 may be pure natural gas or pure hydrogen (e.g., 100% hydrogen, which may or may not contain some amount of contaminants), such that the first fuel is not a mixture of multiple fuels. In exemplary embodiments, the first fuel 158 and pressurized air 15 may mix together within the fuel nozzles 40 to form a first mixture of pressurized air 15 and the first fuel 158 before being ejected (or injected) by the fuel nozzles 40 into the primary combustion zone 72.

The forward casing 50 may be fluidly and mechanically connected to a compressor discharge casing 60, which defines a high-pressure plenum 66 around the combustion liner 46 and the outer sleeve 48. Pressurized air 15 from the compressor section 14 travels through the high-pressure plenum 66 and enters the combustor 17 via apertures (not shown) in the downstream end of the outer sleeve 48 (as indicated by arrows near the aft frame 118). Compressed air travels upstream through the annulus 47 and is turned by the end cover 42 to enter the fuel nozzles 40 and to cool the head end. In particular, pressurized air 15 flows from high-pressure plenum 66 into the annulus 47 at an aft end of the combustor 17, via openings defined in the outer sleeve 48. The pressurized air 15 travels upstream from the aft end of the combustor 17 to the head end air plenum 122, where the pressurized air 15 reverses direction and enters the fuel nozzles 40.

In the exemplary embodiment, the fuel injection assembly 80 is provided to deliver a second fuel/air mixture to a secondary combustion zone 74 downstream from the primary combustion zone 72. For example, a second flow of fuel and air may be introduced by one or more fuel injectors 200 to the secondary combustion zone 74.

The primary combustion zone 72 and the secondary combustion zone 74 may each be portions of the combustion chamber 70 and therefore may be defined by the combustion liner 46. For example, the primary combustion zone 72 may be defined from an outlet of the fuel nozzles 40 to the fuel injector 200, and the secondary combustion zone 74 may be defined from the fuel injector 200 to the aft frame 118. In this arrangement, the forwardmost boundary of the fuel injector 200 may define the end of the primary combustion zone 72 and the beginning of the secondary combustion zone 74 (e.g., at an axial location where a second flow of fuel and air are introduced).

Such a combustion system having axially separated combustion zones is described as an "axial fuel staging" (AFS) system. The fuel injection assemblies 80 may be circumferentially spaced apart from one another on the outer sleeve 48 (e.g., equally spaced apart in some embodiments). In many embodiments, the combustor 17 may include four fuel injection assemblies 80 circumferentially spaced apart from one another and configured to inject a second mixture of fuel and air into a secondary combustion zone 74 via the fuel injector 200. In other embodiments, the combustor 17 may include any number of fuel injection assemblies 80 (e.g., 1, 2, 3, or up to 10).

As shown in FIG. 2, each fuel injection assembly 80 may include the fuel injector 200. The fuel injector 200 may be coupled to the outer sleeve 48 and/or the combustion liner 46 and may be disposed within the annulus 47. Particularly, the fuel injector may extend from the high-pressure plenum 66, through the outer sleeve 48, the annulus 47 and through the combustion liner 46, such that the fuel injector 200 is capable of injecting a secondary flow of fuel/air into the combustion chamber 70.

A fuel supply conduit 102 may fluidly couple to the fuel injector 200. The fuel injector 200 may be in fluid communication with a second fuel supply 152 configured to supply a second fuel 160 to the fuel injector 200 via the fuel supply conduit 102. The second fuel supply 152 may be the same as or different from the first fuel supply 150, such that the fuel injector 200 may be supplied with the same fuel or a different fuel than the fuel nozzles 40. In many embodiments, the second fuel 160 may be a fuel mixture containing natural gas (such as methane, ethane, propane, or other suitable natural gas) and/or hydrogen. In other embodiments, the second fuel 160 may be pure natural gas or pure hydrogen (e.g., 100% hydrogen, which may or may not contain some amount of contaminants), such that the first fuel is not a mixture of multiple fuels. In exemplary embodiments, the second fuel 160 and pressurized air 15 may mix together within the fuel injector 200 to form a mixture of pressurized air 15 and the second fuel 160 before being injected into the secondary combustion zone 74.

Figure 3:
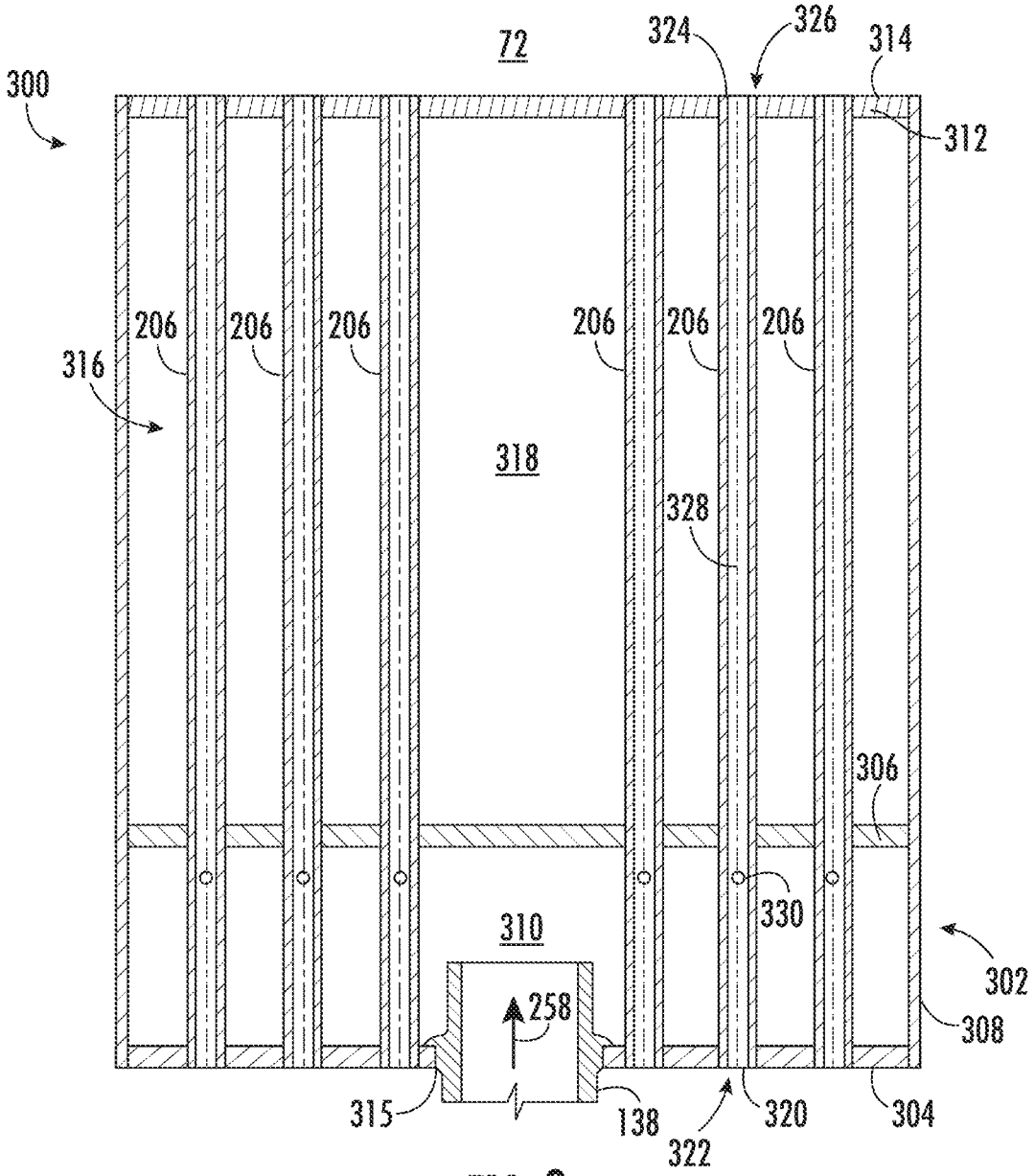
FIG. 3 is a cross-sectional view of a portion of a fuel nozzle as may be employed in the combustor of FIG. 2, in accordance with embodiments of the present disclosure.
Figure 11A:
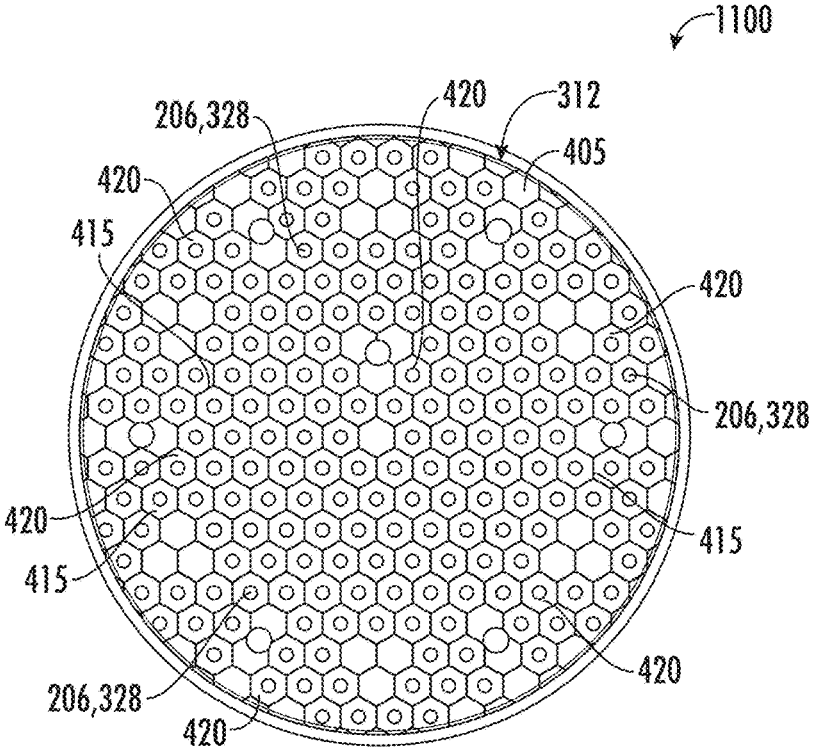
FIG. 11A is a top (aft-looking-forward) view of a portion of a bundled tube fuel nozzle assembly, in accordance with embodiments of the present disclosure.
Figure 11B:
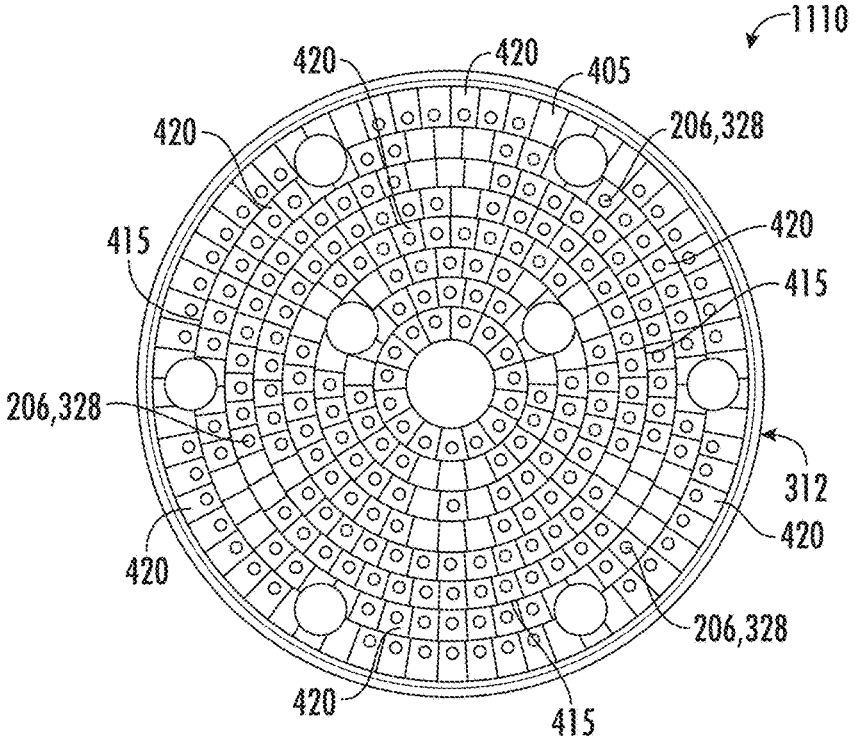
FIG. 11B is a top (aft-looking-forward) view of a portion of a bundled tube fuel nozzle assembly, in accordance with other embodiments of the present disclosure.

FIG. 3 illustrates a cross-sectional side view of a portion of a fuel nozzle 300, in accordance with example embodiments of the present disclosure. More particularly, the fuel nozzle 300 may be a bundled tube fuel nozzle assembly. In exemplary embodiments, each of the fuel nozzles 40 shown in FIG. 2 may be the fuel nozzle 300. Alternately, one or more fuel nozzles 40 may include an array of premixing tubes that fill an entire diameter of the head end, as shown in FIGS. 11A and 11B.

As shown in FIG. 3, the fuel nozzle 300 includes a housing 302 having a forward or upstream plate 304, a divider plate 306 axially spaced from the forward plate 304 and an outer band or sidewall 308 that extends axially between a perimeter of the forward plate 304 and a perimeter of the divider plate 306. At least one fuel plenum 310 is defined within the housing 302. As illustrated, the forward plate 304, the divider plate 306 and the sidewall 308 may at least partially define the at least one fuel plenum 310. In some example embodiments, the forward plate 304 defines at least one fluid inlet 315. The first fuel supply conduit 138 may extend through, or be formed integrally with, the at least one fluid inlet 315 of the forward plate 304 to provide fuel (such as pure hydrogen or a fuel mixture comprising greater than 50% hydrogen) to the at least one fuel plenum 310.

In additional example embodiments, the fuel nozzle 300 includes an aft plate 312 axially spaced from the divider plate 306. A hot side 314 of the aft plate 312 is generally disposed adjacent or proximate to the primary combustion zone 72. The aft plate 312 may be unique to each fuel nozzle 300 (as shown in FIG. 3) or may be common among all the fuel nozzles 300 (e.g., such as the cap plate 44 shown in FIG. 2 or the full aft plate shown in FIGS. 11A and 11B). At least one air plenum 318 is defined within the housing 302. For example, the divider plate 306, the sidewall 308, and the aft plate 312 may at least partially define the at least one air plenum 318. The at least one air plenum 318 may be in fluid communication with the head end air plenum 122.

As shown in FIG. 3, the fuel nozzle 300 may include a tube bundle 316 comprising a plurality of premix tubes 206. Each premix tube 206 may extend through the forward plate 304, the at least one fuel plenum 310, the divider plate 306, the at least one air plenum 318, and the aft plate 312. The premix tubes 206 are fixedly connected to and/or form a seal against the divider plate 306. For example, the premix tubes 206 may be welded, brazed or otherwise connected to the divider plate 306 (e.g., formed integrally with the housing 302 via additive manufacturing). Each premix tube 206 includes a fluid inlet 320 defined at an upstream end 322 of each respective premix tube 206, a fluid outlet 324 defined at a downstream end 326 of each respective premix tube 206, and one or more fuel ports 330 defined between the fluid inlet 320 and the divider plate 306. The one or more fuel ports 330 are in fluid communication with the at least one fuel plenum 310.

Compressed air from the head end air plenum 122 may enter each of the premix tubes 206 at the fluid inlet 320 and may be mixed with fuel (introduced from the at least one fuel plenum 310 via the one or more fuel ports 330) before the fuel/air mixture is expelled through the fluid outlet 324 into the primary combustion zone 72. For example, each premix tube 206 defines a pre-mix flow passage 328 through the fuel nozzle 300, in which fuel (such as pure hydrogen or a fuel mixture comprising greater than 50% hydrogen) may be mixed with compressed air.

Figure 4A:
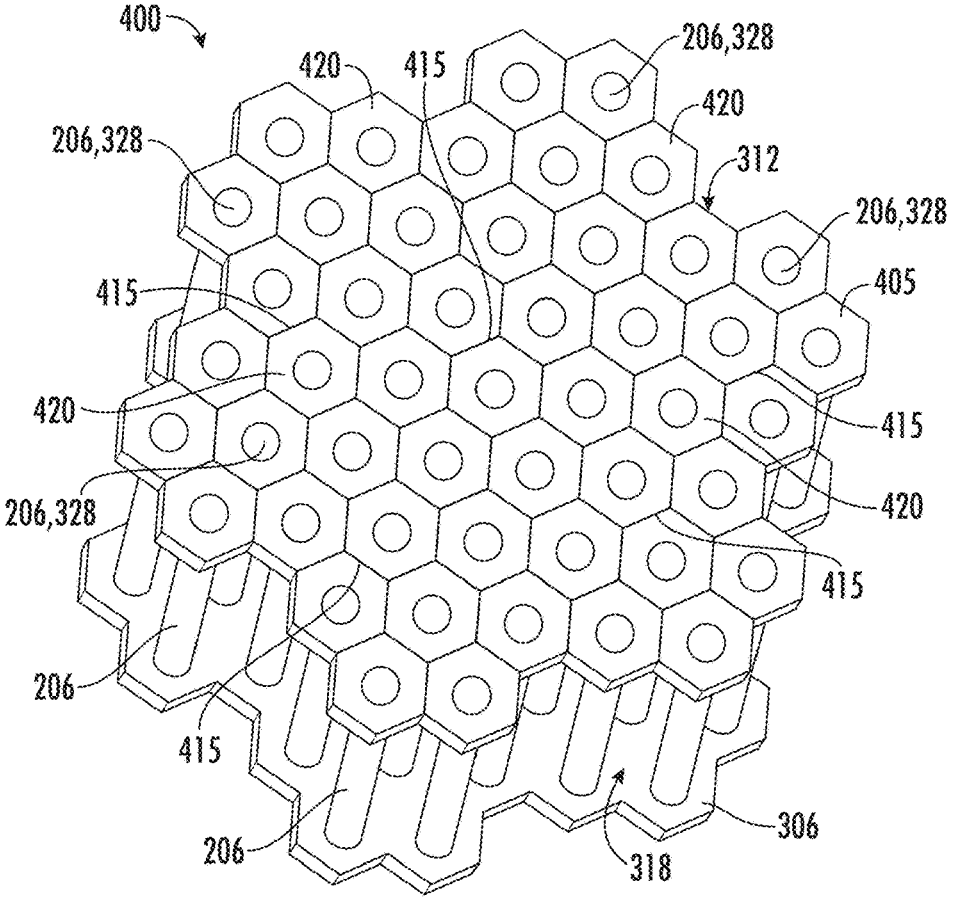
FIG. 4A is a top (aft-looking-forward) perspective view of a portion of a bundled tube fuel nozzle as may be used in the combustor of FIG. 2, in accordance with embodiments of the present disclosure.
Figure 4B:
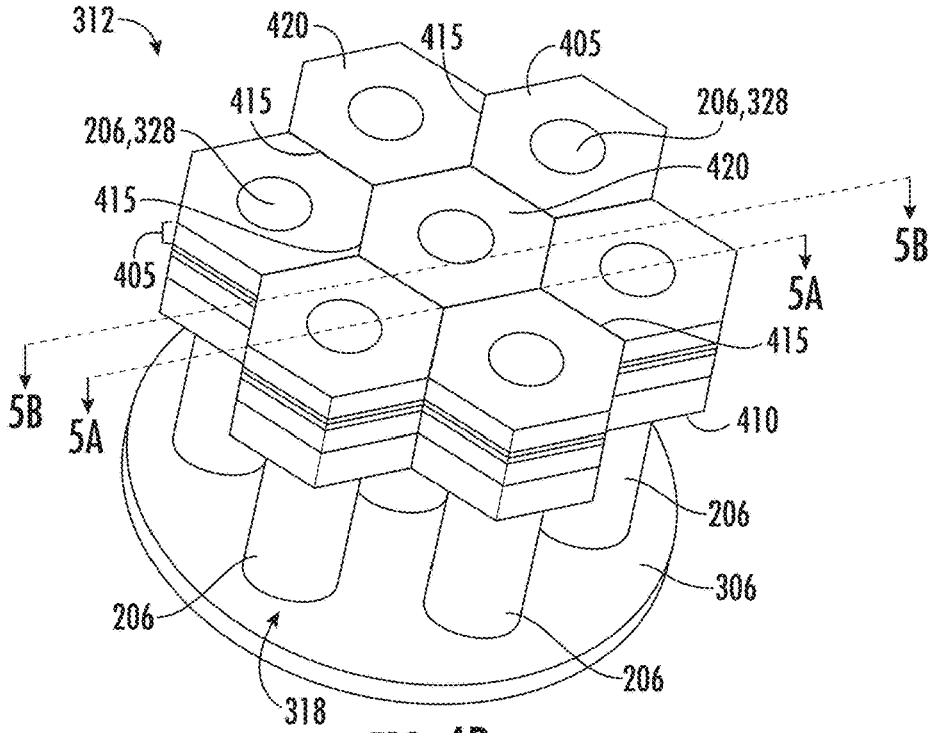
FIG. 4B is a side perspective view of a portion of the bundled tube fuel nozzle of FIG. 4A, in accordance with embodiments of the present disclosure.

FIG. 4A illustrates a top, perspective view of a portion of a bundled tube fuel nozzle 400 with a segmented, or tiled, aft plate 312, in accordance with embodiments of the present disclosure. FIG. 4B is a side, perspective view of a portion of the bundled tube fuel nozzle 400, in accordance with embodiments of the present disclosure. In exemplary embodiments, each of the fuel nozzles 40 shown in FIG. 2 may be the bundled tube fuel nozzle 400. In other exemplary embodiments, one or more of the bundled tube fuel nozzles 400 with the tiled aft plate 312 may define the full span of the combustor head end (e.g., as shown in FIGS. 11A and 11B).

With reference to FIGS. 4A-4B, the aft plate 312 includes a segmented downstream face 405 and a continuous upstream face 410 opposite the segmented downstream face 405. The continuous upstream face 410 is adjacent the at least one air plenum 318, and the segmented downstream face 405 is adjacent the primary combustion zone 72 (FIG. 2). For example, the downstream face 405 includes the hot side 314 of the aft plate 312, as discussed with respect to FIG. 3. The upstream face 410, by comparison, may be referred to as the cold side of the aft plate 312.

In at least one example embodiment, the downstream face 405 is at least partially formed by a plurality of tiles 420, each of which extends radially outward from one or more of the premix tubes 206 of the plurality of premix tubes. A plurality of peripheral openings 415 is defined between adjacent tiles 420. The plurality of peripheral openings 415 surrounds the pre-mix flow passage(s) 328 of one or more of the plurality of premix tubes 206. In some example embodiments, the outlet end of each premix tube 206 may be surrounded by a corresponding tile 420 (i.e., the plurality of peripheral openings 415 may surround each of the pre-mix flow passages 328 of the plurality of premix tubes 206, as shown in FIGS. 4A and 4B). In other example embodiments, the outlet ends of two or more of the premix tubes 206 may be surrounded by a shared tile 420 (i.e., the plurality of peripheral openings 415 may surround two or more of the pre-mix flow passages 328 of the plurality of premix tubes 206, such as will be discussed with respect to FIGS. 8A-8B).

Regardless of whether each premix tube 206 is coupled to an individual tile 420 or whether multiple premix tubes 206 are coupled to a shared tile 420, multiple tiles 420 define the downstream face 405 of the bundled tube fuel nozzle 400 (or, alternately, the downstream face 405 of the combustor head end). While a plurality of tiles 420 collectively define the downstream 405, the upstream face 410 is common to the premix tubes 206 of the bundled tube fuel nozzle 400 (or, alternately, the bundled tube fuel nozzle assembly defining the combustor head end).

Figure 8A:
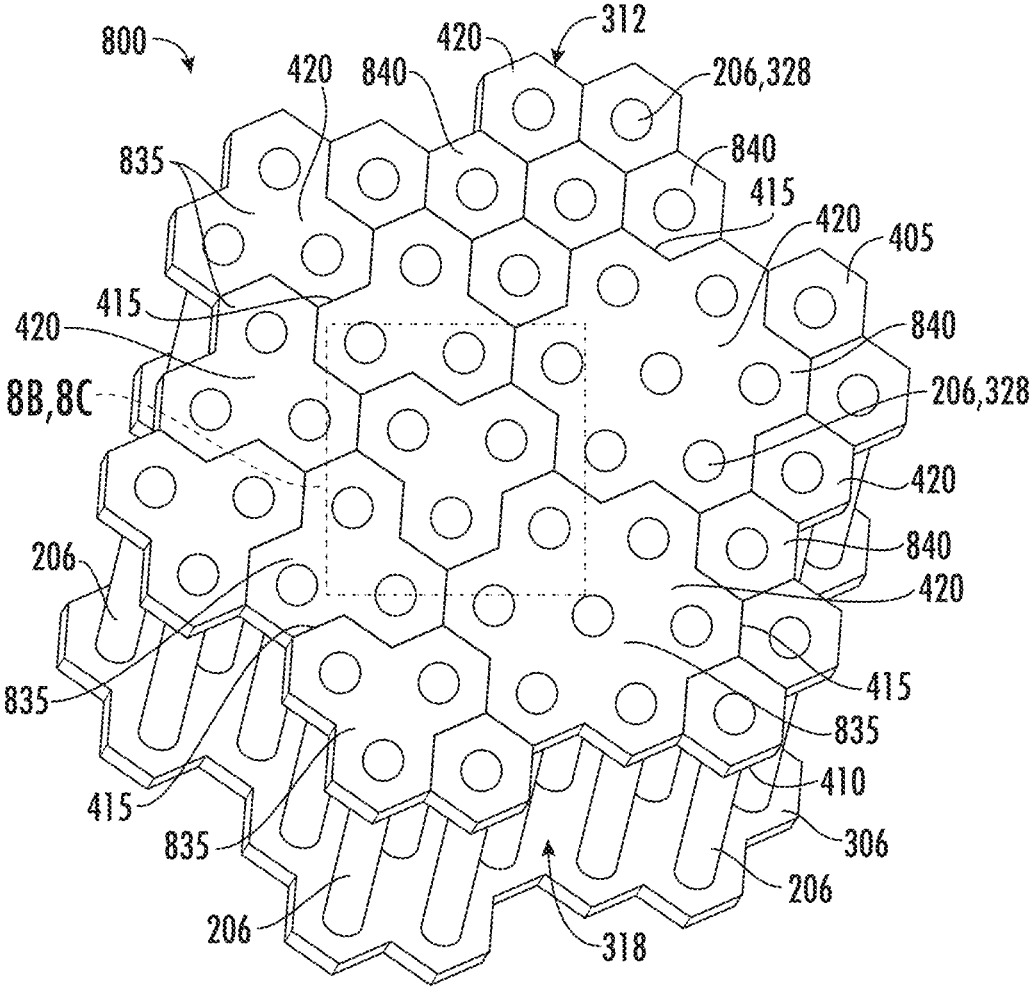
FIG. 8A is a top, perspective view of a portion of a bundled tube fuel nozzle, in accordance with embodiments of the present disclosure.
Figure 8B:
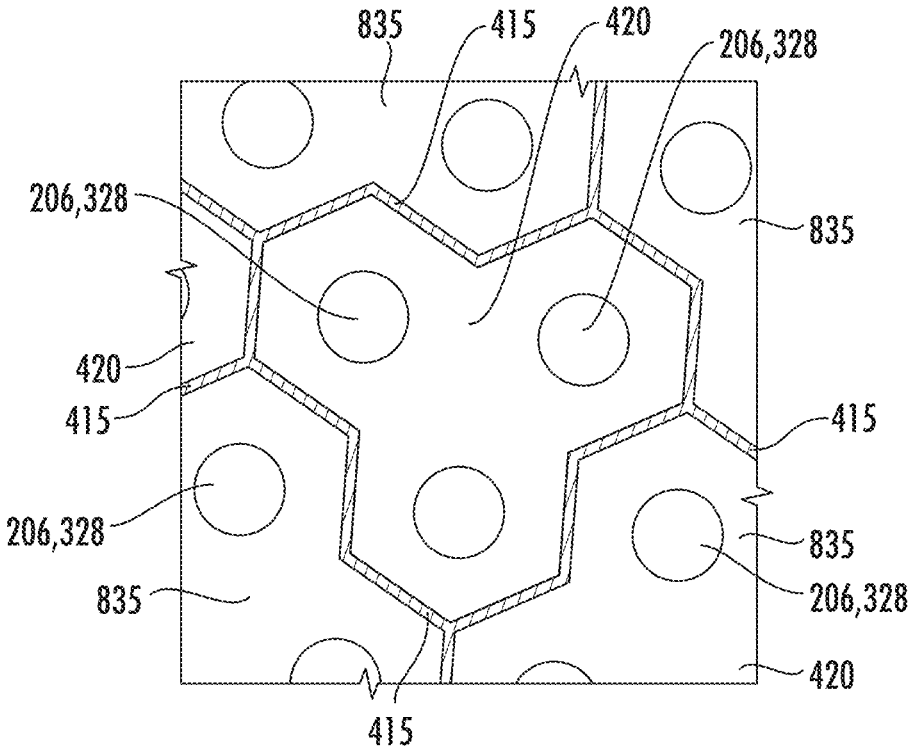
FIG. 8B is a detailed view of a portion of the bundled tube fuel nozzle of FIG. 8A, in accordance with embodiments of the present disclosure.

At least one side of the peripheral openings 415 may be in fluid communication with at least one side of an adjacent one of the peripheral openings 415. For example, the plurality of peripheral openings 415 may define a continuous opening surrounding each of the premix flow passages 328 of the plurality of premix tubes 206 and each of the plurality of tiles 420. In at least one example embodiment, the plurality of tiles 420 may have a polygonal shape. For example, as shown in FIGS. 4A-4B, the plurality of tiles 420 may have a hexagonal shape. In other example embodiments, the plurality of tiles 420 may have a circular or oval shape. In other example embodiments, as shown in FIG. 11B, the plurality of tiles 420 may have the shape of an annular sector, in which a first pair of opposite sides extend along a radius of the aft plate 312 and a second pair of opposite sides are concentric curves. In other exemplary embodiments, as shown in FIGS. 8A and 8B, the tiles 420 are coupled to one or multiple premix tubes 206. Such tiles 420 may have a polygonal (e.g., hexagonal) shape, as shown, or may have an annular sector shape (e.g., as shown in FIG. 11B) where tiles 420 are coupled to multiple premix tubes 206. Said differently, the number of tiles 420 may be equal to the number of premix tubes 206 (as shown in FIGS. 4A, 4B, 11A, and 11B) or may be less than the number of premix tubes 206 (as shown in FIGS. 8A and 8B).

In at least one example embodiment, the downstream faces 405 of the tiles 420 are separated from one another by one or more peripheral openings of the plurality of peripheral openings 415. Such separation between the plurality of tiles 420 of the downstream face 405 of the aft plate 312 prevents a buildup of compressive stresses in the aft plate 312.

For example, because the downstream face 405 faces the primary combustion zone 72, the downstream face 405 is expected to be hotter than the upstream face 410 when the combustor 17 is in use. If the aft plate 312 were made as a continuous plate, the temperature difference between the downstream face 405 and the upstream face 410 may cause the aft plate 312 to bow as the hotter downstream face 405 expands. Such bowing of the aft plate 312 causes thermally driven stresses.

The separation between the plurality of tiles 420 at the aft plate 312 may at least partially reduce the thermally driven stresses within the bundled tube fuel nozzle 400. For example, the plurality of peripheral openings 415 allows at least some movement (i.e., thermal expansion) between one or more of the plurality of tiles 420 at the aft plate 312 in response to the temperature difference between the downstream face 405 and the upstream face 410, which may prevent bowing of the aft plate 312. As a result, the cyclical fatigue of the component will be reduced, thereby extending its operating life.

Figure 5A:
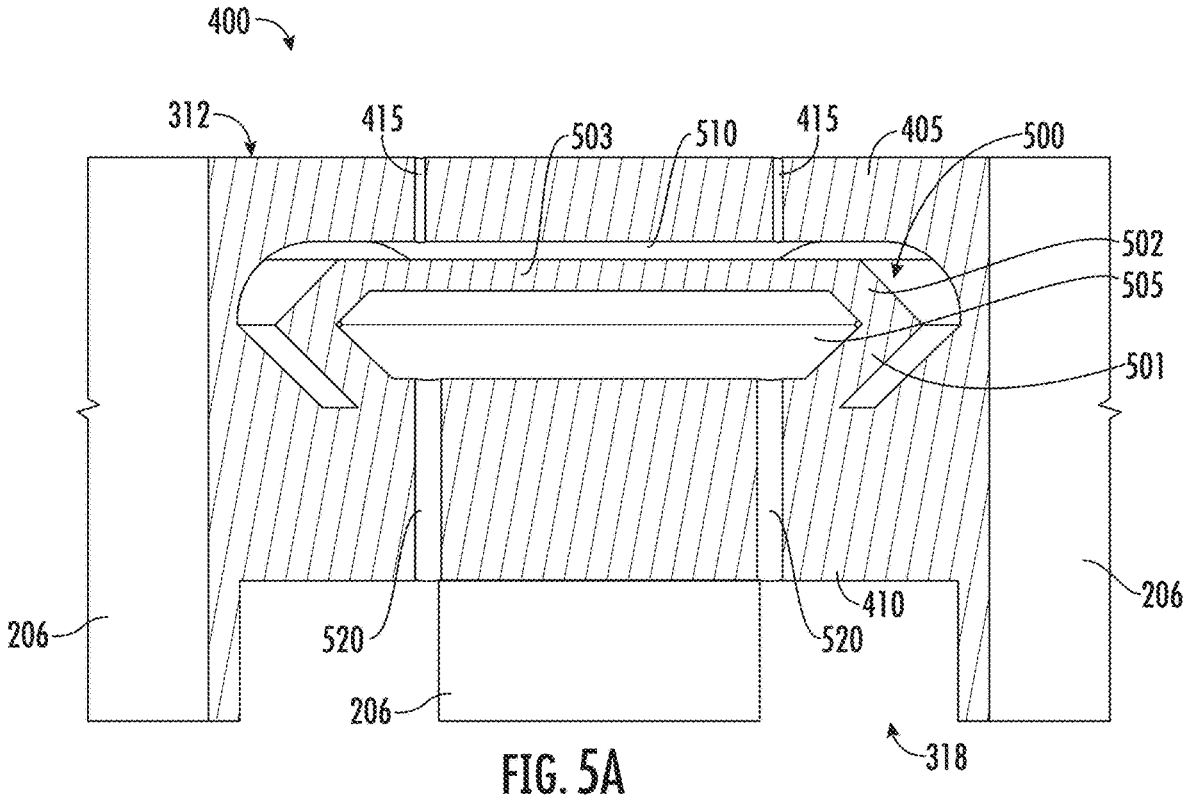
FIG. 5A is a cross-sectional view of a portion of the bundled tube fuel nozzle of FIGS. 4A-4B along line 5A-5A, in accordance with embodiments of the present disclosure.
Figure 5B:
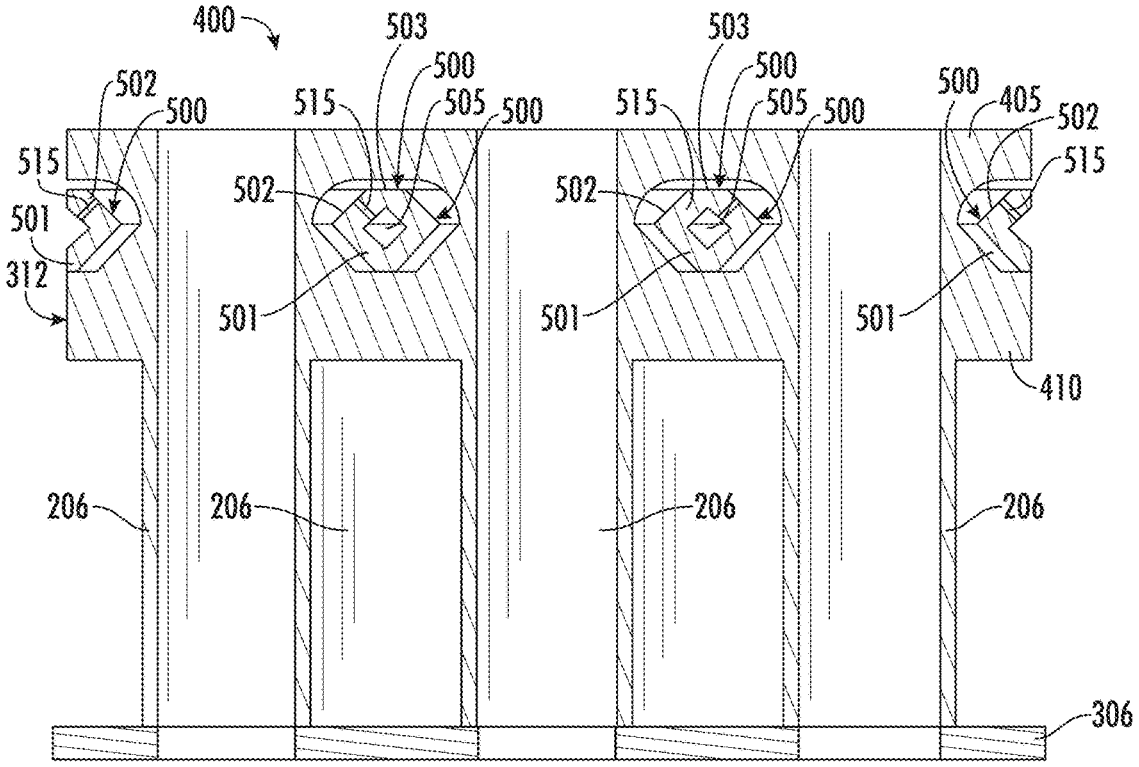
FIG. 5B is a cross-sectional view of a portion of the bundled tube fuel nozzle of FIGS. 4A-4B along line 5B-5B, in accordance with embodiments of the present disclosure.
Figure 5C:
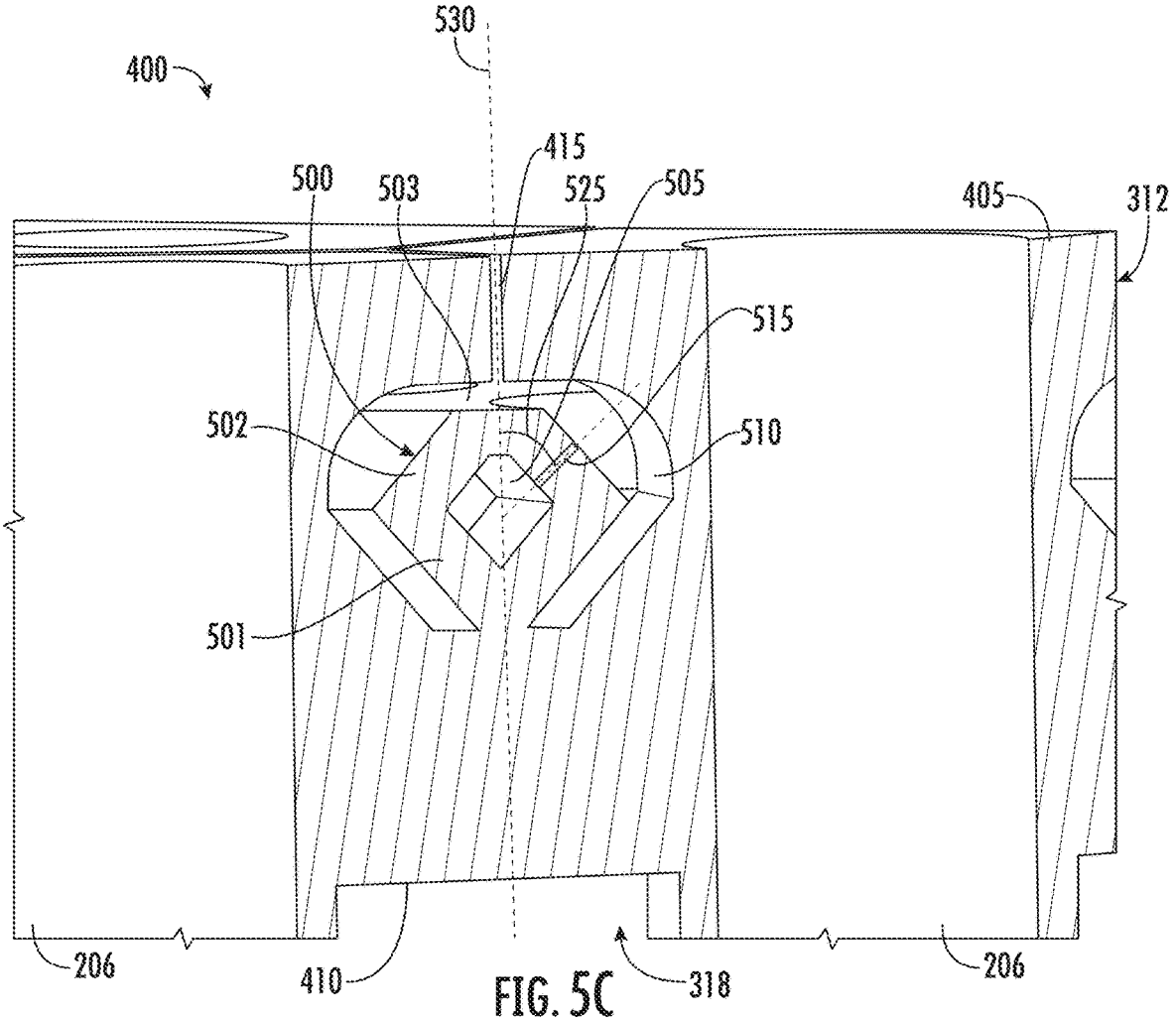
FIG. 5C is a detailed, perspective view of a portion of the bundled tube fuel nozzle of FIG. 5B, in accordance with embodiments of the present disclosure.

FIG. 5A illustrates a cross-sectional view of a portion of the bundled tube fuel nozzle 400 of FIGS. 4A-4B along line 5A-5A, in accordance with embodiments of the present disclosure. FIG. 5B illustrates a cross-sectional view of a portion of the bundled tube fuel nozzle 400 of FIGS. 4A-4B along line 5B-5B, in accordance with embodiments of the present disclosure. FIG. 5C is a detailed, perspective view of a portion of the bundled tube fuel nozzle 400 of FIG. 5B, in accordance with embodiments of the present disclosure.

In at least one example embodiment, the aft plate 312 includes an annular impingement portion 500 disposed between the upstream face 410 and the downstream face 405. The annular impingement portion 500 defines a first plenum 505. With reference to FIG. 5A, the annular impingement portion 500 may include a first wall portion 501, a second wall portion 502, and a third wall portion 503. The first wall portion 501 may extend from a proximal end at the upstream face 410 to a distal end oriented towards the downstream face 405. As shown in FIG. 5A, the first wall portion 501 may extend at an angle relative to the upstream face 410. The second wall portion 502 may extend from the distal end of the first wall portion 501 opposite the upstream face 410. As also shown in FIG. 5A, the second wall portion 502 may extend from the first wall portion 501 towards the downstream face 405. The second wall portion 502 may extend at an angle relative to the first wall portion 501. In at least one example embodiment, the second wall portion 502 extends at about a 90° angle relative to the first wall portion 501. In other example embodiments, the second wall portion 502 may extend at an angle relative to the first wall portion 501 that is greater than or less than about 90°.

The first wall portion 501 and the second wall portion 502 may each include annular walls surrounding one or more of the plurality of premix tubes 206. In at least one example embodiment, the third wall portion 503 extends between ends of the second wall portion 502 opposite the first wall portion 501 and defines a surface parallel to the downstream face 405. The first wall portion 501, the second wall portion 502, and the third wall portion 503 of the annular impingement portion 500 collectively define the first plenum 505. Moreover, the third wall portion 503 may at least partially define each of the pre-mix flow passage 328 of the plurality of premix tubes 206.

In at least one example embodiment, the aft plate 312 defines a second plenum 510 between the annular impingement portion 500, the upstream face 405, and the downstream face 410. More specifically, the second plenum 510 may be defined between an inner surface of the downstream face 405 and the first wall portion 501, the second wall portion 502, and the third wall portion 503 of the annular impingement portion 500. Accordingly, the second plenum 510 may at least partially surround the first plenum 505. Moreover, the inner surface of the downstream face 405 may have an arcuate shape. For example, at least a portion of the inner surface of the downstream face 405 opposite the second wall portion 502 may be curved or arcuate.

Still referring to FIG. 5A, the upstream face 410 of the aft plate 312 defines at least one inlet passage 520 (e.g., an axially extending aperture). The at least one inlet passage 520 may be in fluid communication with the at least one air plenum 318 and the first plenum 505. For example, the at least one inlet passage 520 is configured to deliver a fluid, such as a cooling airflow, from the at least one air plenum 318 to the first plenum 505.

With reference to FIGS. 5B-5C, the annular impingement portion 500 defines at least one impingement passage 515 extending from the first plenum 505 towards the downstream face 405. For example, the second wall portion 502 of the annular impingement portion 500 may define the at least one impingement passage 515. The at least one impingement passage 515 may be in fluid communication with the first plenum 505 and the second plenum 510. Additionally, the at least one impingement passage 515 is configured to direct the fluid from the first plenum 505, such as the cooling airflow, to the second plenum 510 such that the fluid is directed upon an inner surface of the downstream face 405. Moreover, the cooling airflow may exit the second plenum 510 via the plurality of peripheral openings 415.

As shown in FIG. 5C, the at least one impingement passage 515 may extend at an angle 525 relative to a vertical axis 530 extending between the divider plate 306 and the aft plate 312. In at least one example embodiment, the angle 525 may be greater than or equal to about 30° and less than or equal to about 60°. In the illustrated embodiment, the angle 525 is about 45°.

In at least one example embodiment, the fluid or the cooling airflow is directed upon the inner surface of the downstream face 405. The cooling airflow is configured to cool the downstream face 405, which may further prevent thermal stresses within the bundled tube fuel nozzle 400. For example, cooling of the downstream face 405 may prevent bowing of the aft plate 312 due to temperature differences between the downstream face 405 and the upstream face 410. The plurality of peripheral openings 415 accommodate thermal growth of the tiles 420 of the aft face 312, while allowing cooling fluid to pass through peripheral openings 415 and into the combustion zone 72.

Figure 6:
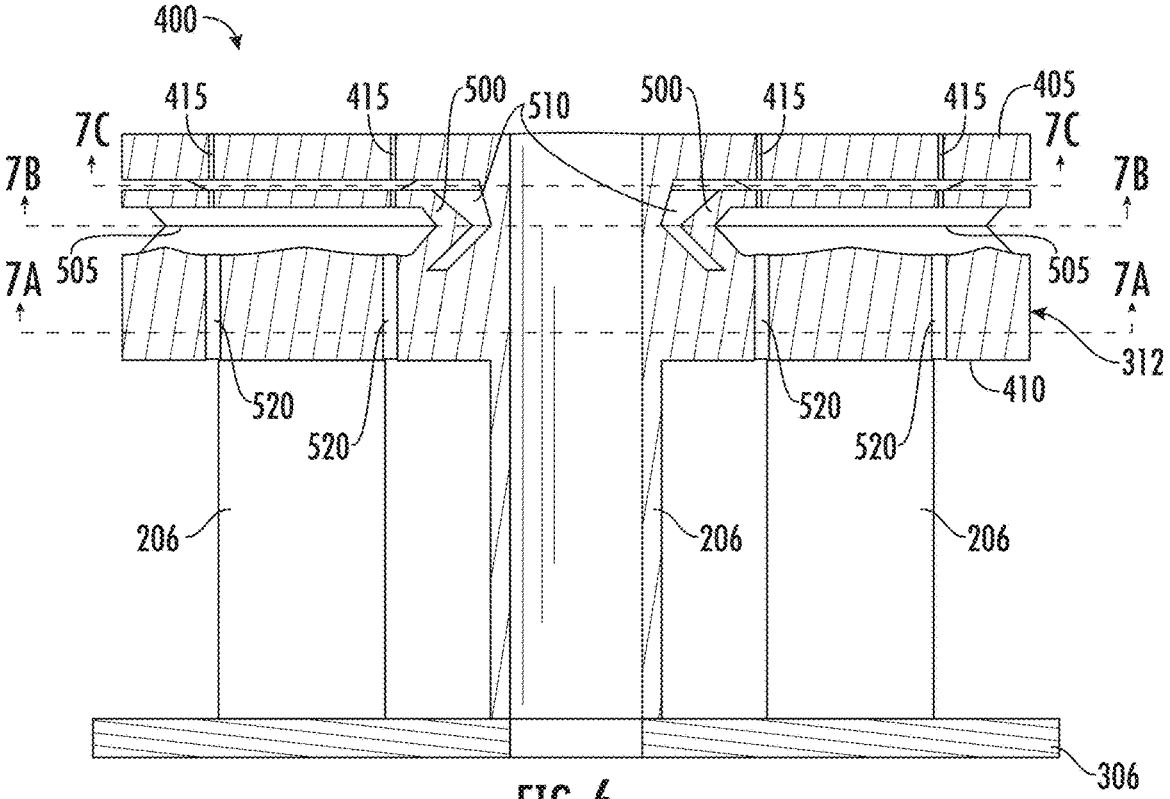
FIG. 6 is a cross-sectional view of a portion of the bundled tube fuel nozzle of FIGS. 4A-4B along line 5A-5A, in accordance with embodiments of the present disclosure.
Figure 7A:
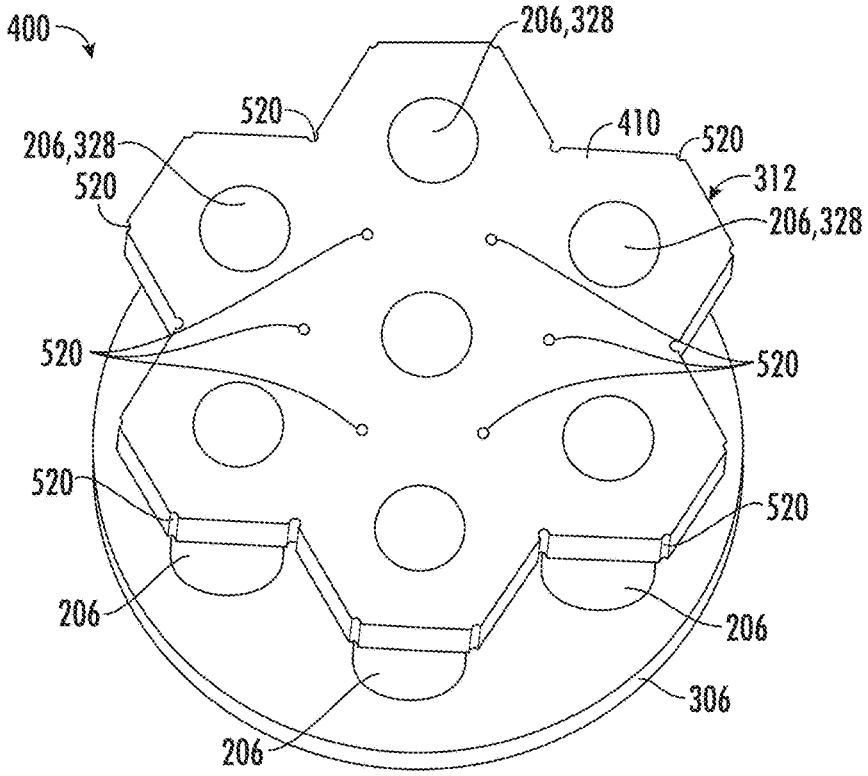
FIG. 7A is a cross-sectional view of a portion of the bundled tube fuel nozzle of FIG. 6 along line 7A-7A, in accordance with embodiments of the present disclosure.
Figure 7B:
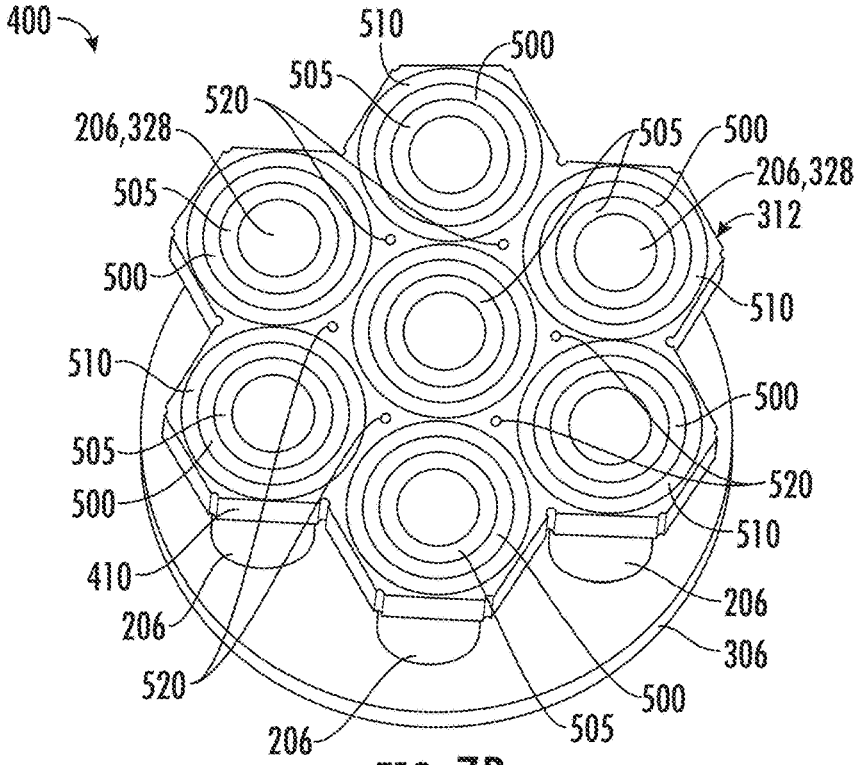
FIG. 7B is a cross-sectional view of a portion of the bundled tube fuel nozzle of FIG. 6 along line 7B-7B, in accordance with embodiments of the present disclosure.
Figure 7C:
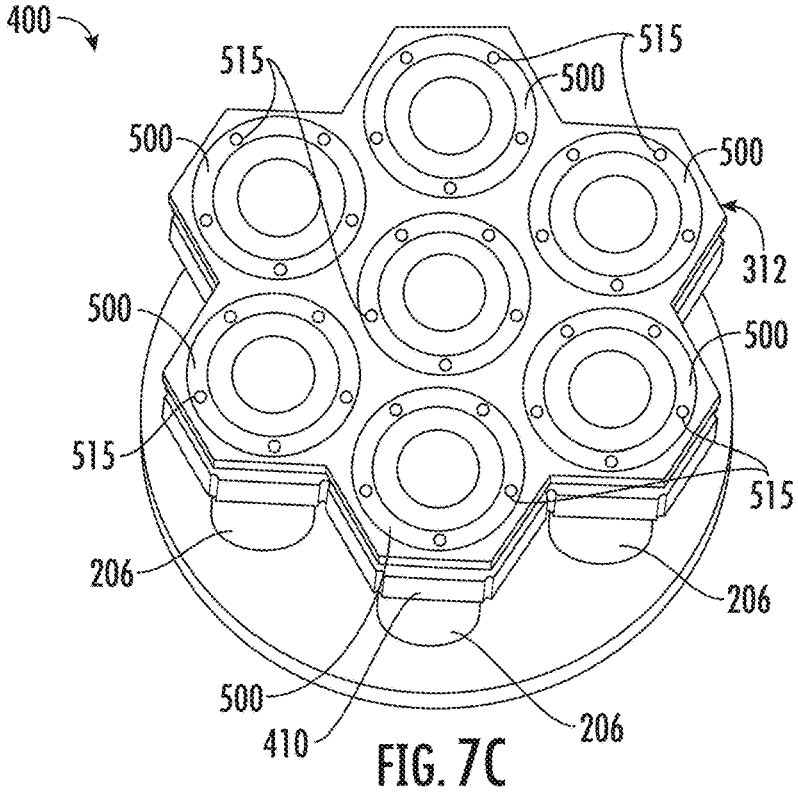
FIG. 7C is a cross-sectional view of a portion of the bundled tube fuel nozzle of FIG. 6 along line 7C-7C, in accordance with embodiments of the present disclosure.

FIG. 6 illustrates a cross-sectional view of a portion of the bundled tube fuel nozzle 400 of FIGS. 4A-4B along line 5A-5A, in accordance with embodiments of the present disclosure. FIG. 7A illustrates a cross-sectional view of a portion of the bundled tube fuel nozzle 400 of FIG. 6 along line 7A-7A, in accordance with embodiments of the present disclosure. FIG. 7B illustrates a cross-sectional view of a portion of the bundled tube fuel nozzle 400 of FIG. 6 along line 7B-7B, in accordance with embodiments of the present disclosure. FIG. 7C illustrates a cross-sectional view of a portion of the bundled tube fuel nozzle 400 of FIG. 6 along line 7C-7C, in accordance with embodiments of the present disclosure. As shown in FIGS. 7A-7C, which illustrate the upstream face 410 of the aft plate 312, the upstream face 410 is continuous across the bundled tube fuel nozzle 400 or, alternately, the entire combustor head end assembly.

As shown in FIG. 7A, the upstream face 410 of the aft plate 312 defines the at least one inlet passage 520. The at least one inlet passage 520 may be a plurality of inlet passages 520 surrounding the pre-mix flow passage 328 of each of the plurality of premix tubes 206. For example, the plurality of inlet passages 520 may be equally spaced about the pre-mix flow passage 328 of each of the plurality of premix tubes 206. In embodiments in which the tiles 420 of the downstream face 405 are hexagonal, the inlet passages 520 may be aligned with the corners of the hexagonal tiles 420. The inlet passages 520 may be located in other or additional locations.

With reference to FIG. 7B, the first plenum 505 is an annular plenum surrounding the pre-mix flow passage 328 of each of the plurality of premix tubes 206. Additionally, the second plenum 510 may also be annular and surround the first plenum 505. The first plenum 505 is in fluid communication with the second plenum 510 via the at least one impingement passage 515. As shown in FIG. 7C, the annular impingement portion 500 defines the at least one impingement passage 515. The at least one impingement passage 515 may be a plurality of impingement passages 515 surrounding the first plenum 505. In at least one example embodiment, the plurality of impingement passages 515 may be equally spaced apart from one another about the first plenum 505.

Figure 8C:
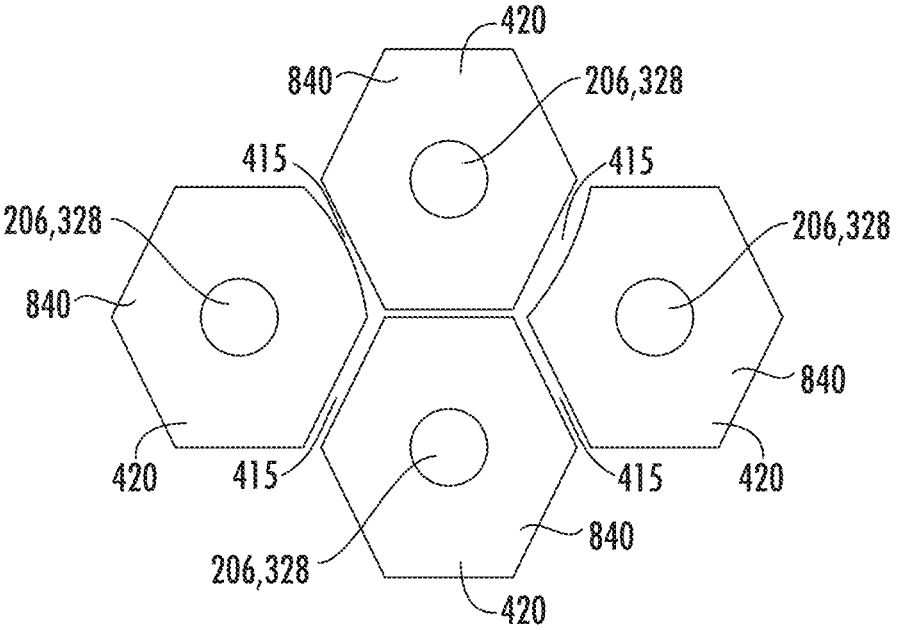
FIG. 8C is a detailed view of a portion of the bundled tube fuel nozzle of FIG. 8A, in accordance with embodiments of the present disclosure.

FIG. 8A illustrates a top, perspective view of a portion of a bundled tube fuel nozzle 800, in accordance with embodiments of the present disclosure. FIG. 8B illustrates a detailed view of a portion of the bundled tube fuel nozzle 800 of FIG. 8A, in accordance with embodiments of the present disclosure. FIG. 8C illustrates a detailed view of a portion of the bundled tube fuel nozzle 800 of FIG. 8A, in accordance with embodiments of the present disclosure. In exemplary embodiments, each of the fuel nozzles 40 shown in FIG. 2 may be the bundled tube fuel nozzle 800. Moreover, the bundled tube fuel nozzle 800 may be similar or analogous to the exemplary fuel nozzles 40 shown in FIG. 2, the bundled tube fuel nozzle 300 shown in FIG. 3, and the bundled tube fuel nozzle 400 discussed above with respect to FIGS. 4A-7C. It should be understood that the bundled tube fuel nozzle 800 may have fewer or more premix tubes 206 than illustrated in FIG. 8A and may have more or fewer aft plates 312 than illustrated in FIG. 8A.

For example, the bundled tube fuel nozzle 800 includes the plurality of premix tubes 206, each of which extends through the forward plate 304 (FIG. 3), the divider plate 306, and one tile 420 of the aft plates 312. The bundled tube fuel nozzle 800 also defines the at least one air plenum 318 between the divider plate 306, the aft plate 312, and the plurality of premix tubes 206. Additionally, the aft plate 312 includes the continuous upstream face 410 and the segmented downstream face 405 opposite the upstream face 410.

The downstream face 405 of the bundled tube fuel nozzle 800 also defines the plurality of tiles 420 and the plurality of peripheral openings 415 between adjacent tiles of the plurality of tiles 420. As shown in FIG. 8B, the plurality of peripheral openings 415 may surround at least one of the plurality of tiles 420, which surround at least one of the pre-mix flow passages 328 of the plurality of premix tubes 206. In at least one example embodiment, the plurality of peripheral openings 415 may define a uniform gap between the plurality of tiles 420, as shown (e.g., with cross-hatching) in FIG. 8B. For example, a flow path defined by the plurality of peripheral openings 415 may have a constant diameter in a direction of the flow path. Additionally, or alternatively, the plurality of peripheral openings 415 may include a non-uniform gap between two or more of the plurality of tiles 420, as shown in FIG. 8C.

In some example embodiments, at least one of the plurality of tiles 420 may surround multiple premix tubes 206, such that the plurality of peripheral openings 415 may surround two or more of the pre-mix flow passages 328 of the plurality of premix tubes 206. For example, as shown in FIG. 8A, the plurality of peripheral openings 415 may surround three of the pre-mix flow passages 328 of the plurality of premix tubes 206 to define one or more tube groupings 835.

In some example embodiments, the bundled tube fuel nozzle 800 may include one or more tube groupings having a varying number of the plurality of premix tubes 206. For example, as shown in FIG. 8A, the bundled tube fuel nozzle 800 includes the one or more tube groupings 835 having three or more of the plurality of premix tubes 206 and a plurality of single tube groups 840.

The one or more tube groupings 835 may reduce a number of the plurality of peripheral openings 415 of the bundled tube fuel nozzle 800 such that an amount of fluid or cooling air flowing from the second plenum 510 via the plurality of peripheral openings 415 may be reduced. Accordingly, a pressure ratio across the downstream face 405 may be maintained such that hot combustion gases are not ingested into the bundled tube fuel nozzle 800 via the plurality of peripheral openings 415.

Figure 9:
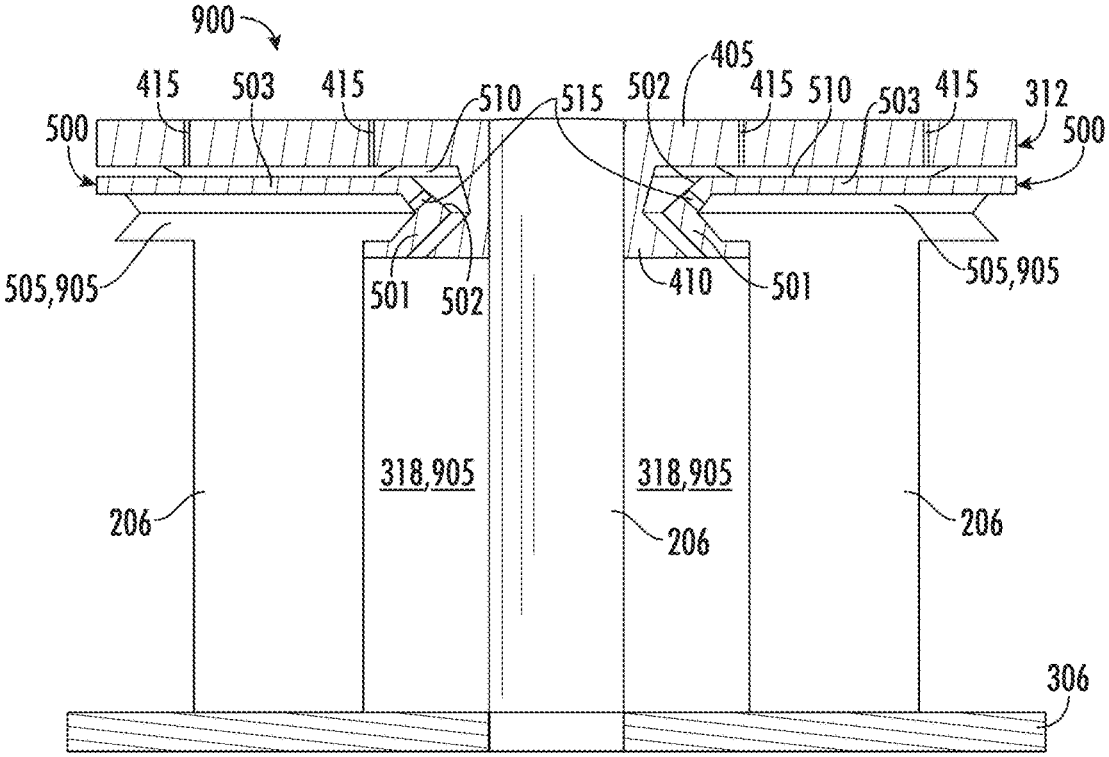
FIG. 9 is a cross-sectional view of a portion of a bundled tube fuel nozzle, in accordance with embodiments of the present disclosure.

FIG. 9 illustrates a cross-sectional view of a portion of a bundled tube fuel nozzle 900, in accordance with embodiments of the present disclosure. In exemplary embodiments, each of the fuel nozzles 40 shown in FIG. 2 may be the bundled tube fuel nozzle 900. Moreover, the bundled tube fuel nozzle 900 may be similar or analogous to the exemplary bundled tube fuel nozzles 400, 800 discussed above with respect to FIGS. 4A-8.

For example, the bundled tube fuel nozzle 900 includes the plurality of premix tubes 206 extending from the forward plate 304 (FIG. 3), through the divider plate 306, and to the aft plate 312. The bundled tube fuel nozzle 900 also defines the at least one air plenum 318 between the divider plate 306, the aft plate 312, and the plurality of premix tubes 206. Additionally, as described previously, the aft plate 312 includes the continuous upstream face 410 (through which all premix tubes 206 of the bundled tube fuel nozzle 900 extend) and the segmented downstream face 405 (through which one or more of the premix tubes 206 extend) opposite the upstream face 410.

The aft plate 312 includes the annular impingement portion 500 disposed between the upstream face 410 and the downstream face 405. The annular impingement portion 500 defines the first plenum 505. For example, the first plenum 505 is defined between the first wall portion 501, the second wall portion 502, and the third wall portion 503, as previously described. The aft plate 312 also defines the second plenum 510 between the annular impingement portion 500, the upstream face 405, and the downstream face 410. More specifically, the second plenum 510 may be defined between the inner surface of the downstream face 405 and the first wall portion 501, the second wall portion 502, and the third wall portion 503 of the annular impingement portion 500. Accordingly, the second plenum 510 may at least partially surround the first plenum 505. Moreover, the annular impingement portion 500 defines the at least one impingement passage 515 extending from the first plenum 505 towards the downstream face 405. For example, the second wall portion 502 of the annular impingement portion 500 may define the at least one impingement passage 515. The at least one impingement passage 515 may be in fluid communication with the first plenum 505 and the second plenum 510.

In at least one example embodiment, the first plenum 505 is in direct fluid communication with the at least one air plenum 318. For example, the first plenum 505 and the at least one air plenum 318 may be a single, integral chamber, such as a chamber 905. In such embodiments, the cooling airflow may be provided to the second plenum 510 via the at least one impingement passage 515 directly from the chamber 905.

Figure 10:
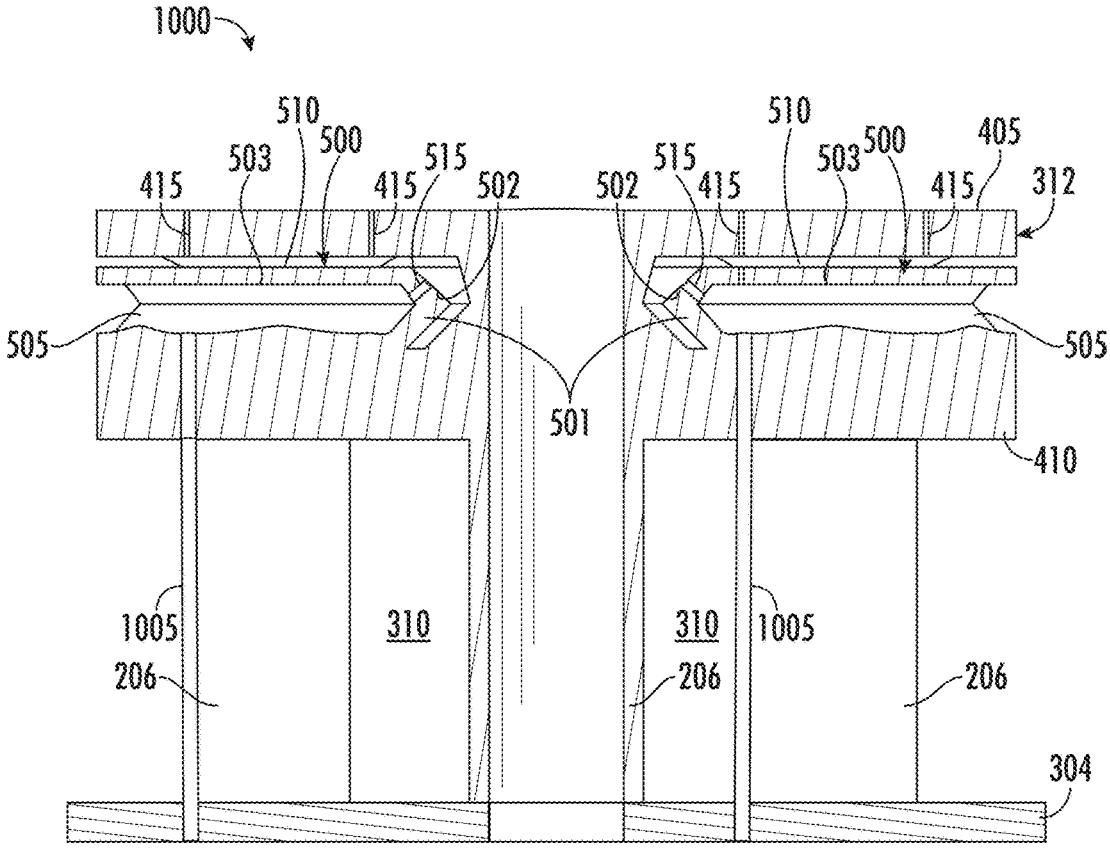
FIG. 10 is a cross-sectional view of a portion of a bundled tube fuel nozzle, in accordance with embodiments of the present disclosure.

FIG. 10 illustrates a cross-sectional view of a portion of a bundled tube fuel nozzle 1000, in accordance with embodiments of the present disclosure. In exemplary embodiments, each of the fuel nozzles 40 shown in FIG. 2 may be the bundled tube fuel nozzle 1000. Moreover, the bundled tube fuel nozzle 1000 may be similar or analogous to the exemplary bundled tube fuel nozzles 400, 800, 900 discussed above with respect to FIGS. 4A-9.

In at least one example embodiment, the bundled tube fuel nozzle 1000 includes the plurality of premix tubes 206 extending through the forward plate 304 and the aft plate 312. The bundled tube fuel nozzle 1000 also defines the at least one fuel plenum 310 between the forward plate 304, the aft plate 312, and the plurality of premix tubes 206. Additionally, the aft plate 312 includes the continuous upstream face 410 and the segmented downstream face 405 opposite the upstream face 410.

The aft plate 312 includes the annular impingement portion 500 disposed between the upstream face 410 and the downstream face 405. The annular impingement portion 500 defines a first plenum 505. For example, the first plenum 505 is defined between the first wall portion 501, the second wall portion 502, and the third wall portion 503. The aft plate 312 also defines the second plenum 510 between the annular impingement portion 500, the upstream face 410, and the downstream face 405. More specifically, the second plenum 510 may be defined between the inner surface of the downstream face 405 and the first wall portion 501, the second wall portion 502, and the third wall portion 503 of the annular impingement portion 500. Accordingly, the second plenum 510 may at least partially surround the first plenum 505. Moreover, the annular impingement portion 500 defines the at least one impingement passage 515 extending from the first plenum 505 towards the downstream face 405. For example, the second wall portion 502 of the annular impingement portion 500 may define the at least one impingement passage 515. The at least one impingement passage 515 may be in fluid communication with the first plenum 505 and the second plenum 510.

In at least one example embodiment, the bundled tube fuel nozzle 1000 includes a plurality of cooling channels 1005. The plurality of cooling channels 1005 may be adjacent to and extend along a length of the plurality of premix tubes 206. Additionally, the plurality of cooling channels 1005 may be configured to deliver a fluid, such as a cooling airflow, to the first plenum 505. For example, the cooling channel 1005 may be in fluid communication with the head end air plenum 122 (FIG. 2). The first plenum 505 may receive the cooling airflow via the cooling channel 1005, and the cooling airflow may be directed onto the inner surface of the downstream face 405 via the at least one impingement passage 515 and the second plenum 510, discussed above with respect to FIGS. 5A-5C.

FIG. 11A illustrates a top view of a portion of a bundled tube fuel nozzle assembly 1100 that spans a combustor head end, in accordance an example embodiment of the present disclosure. FIG. 11B illustrates a top view of a portion of the bundled tube fuel nozzle assembly 1110 that spans a combustor head end, in accordance with another example embodiment of the present disclosure. In exemplary embodiments, each of the fuel nozzles 40 shown in FIG. 2 may be included in the bundled tube fuel nozzle assembly 1100, 1110. Moreover, the bundled tube fuel nozzle 1100, 1100 may include components similar or analogous to the exemplary bundled tube fuel nozzle 400, 800, 900, 1000, discussed above with respect to FIGS. 4A-10.

For example, the bundled tube fuel nozzle 1100 includes the plurality of premix tubes 206 extending through the forward plate 304 (FIG. 3), the divider plate 306 (FIGS. 3-4B, 5B, 6-10), and the aft plate 312. The upstream face 405 of the bundled tube fuel nozzle 1100 also defines the plurality of tiles 420 separated by the plurality of peripheral openings 415. The plurality of peripheral openings 415 may surround the pre-mix flow passage 328 of the plurality of premix tubes 206 and the plurality of tiles 420. In some example embodiments, a respective tile 420 of the plurality of tiles 420 may surround each of the pre-mix flow passages 328 of the plurality of premix tubes 206, such that a peripheral opening 415 also surrounds each pre-mix flow passage 328. In other example embodiments, the plurality of tiles 420 and the plurality of peripheral openings 415 may surround two or more of the pre-mix flow passages 328 of the plurality of premix tubes 206, as described with respect to FIGS. 8A-8B.

In at least one example embodiment, as shown in FIG. 11A, the plurality of peripheral openings 415 and the plurality of tiles 420 may have a hexagonal shape. In another example embodiment, as shown in FIG. 11B, the plurality of peripheral openings 415 and the plurality of tiles 420 may have an annular sector shape (that is, a shape having opposite straight edges and opposite curved edges). In other example embodiments, plurality of peripheral openings 415 and the plurality of tiles 420 have a circular shape, an oval shape, or any polygonal shape having three or more sides.

Figure 12:
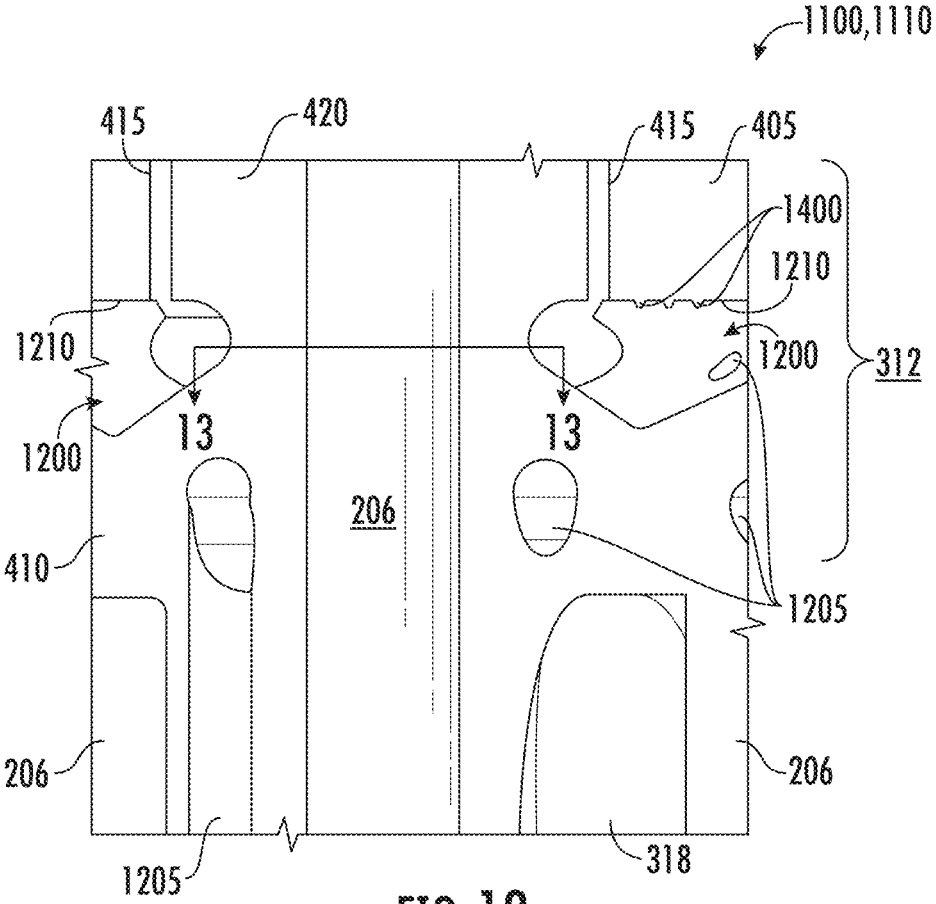
FIG. 12 is a cross-sectional view of a portion of the bundled tube fuel nozzle assembly of FIGS. 11A-11B, in accordance with embodiments of the present disclosure.
Figure 13:
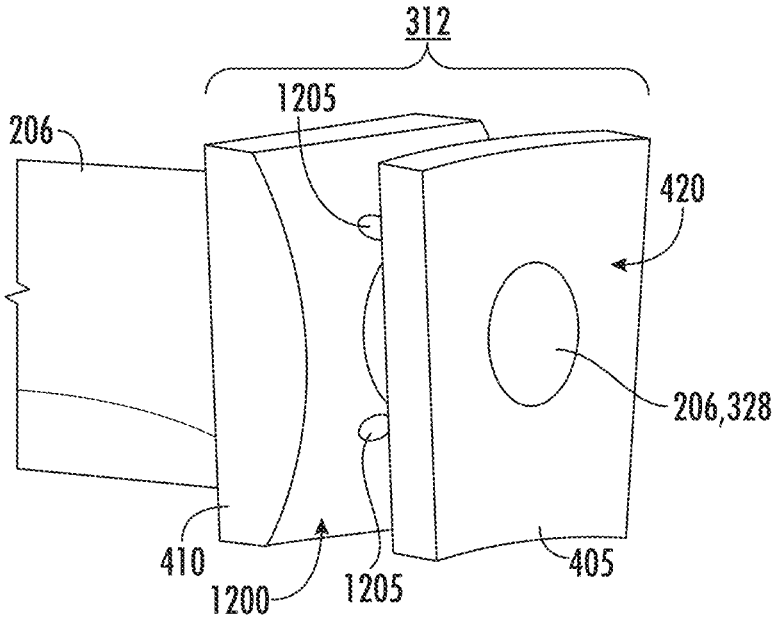
FIG. 13 is a perspective view of one of a plurality of premix tubes and one of the tiles of the aft plate of the bundled tube fuel nozzle assembly of FIG. 11B, in accordance with embodiments of the present disclosure.

FIG. 12 illustrates a cross-sectional view of a portion of the bundled tube fuel nozzle assembly 1100, 1110 of FIGS. 11A-11B, in accordance with embodiments of the present disclosure. FIG. 13 illustrates a perspective view of one of the plurality of premix tubes 206 and one of the tiles 420 of the aft plate 312 of the bundled tube fuel nozzle assembly 1110 of FIG. 11B, in accordance with embodiments of the present disclosure.

The bundled tube fuel nozzle assembly 1100, 1110 includes the at least one air plenum 318 surrounding at least a portion of the plurality of premix tubes 206. Additionally, the aft plate 312 includes the continuous upstream face 410 and the tiled downstream face 405 opposite the upstream face 410. The aft plate 312 defines an air plenum, such as a plenum 1200, surrounding each of the plurality of premix tubes 206 between the upstream face 410 and the downstream face 405.

In at least one example embodiment, the bundled tube fuel nozzle assembly 1100, 1110 includes a plurality of cooling channels 1205 in fluid communication with the plenum 1200. The plurality of cooling channels 1205 may be adjacent to and extend along a length of the plurality of premix tubes 206. The plurality of cooling channels 1205 may be configured to deliver a fluid, such as a cooling airflow, to the plenum 1200. For example, the cooling channel 1205 may be in fluid communication with the head end air plenum 122 (FIG. 2). The plenum 1200 may receive the cooling airflow via the cooling channel 1205, and the cooling airflow may be directed onto an inner surface 1210 of the downstream face 405. In at least one example embodiment, the plurality of cooling channels 1205 extend normal to the upstream face 410 and the downstream face 405 of the aft plate 312. As described above, the downstream face 405 includes a plurality of tiles 420 that are separated by perimeter openings 415.

Figure 14:
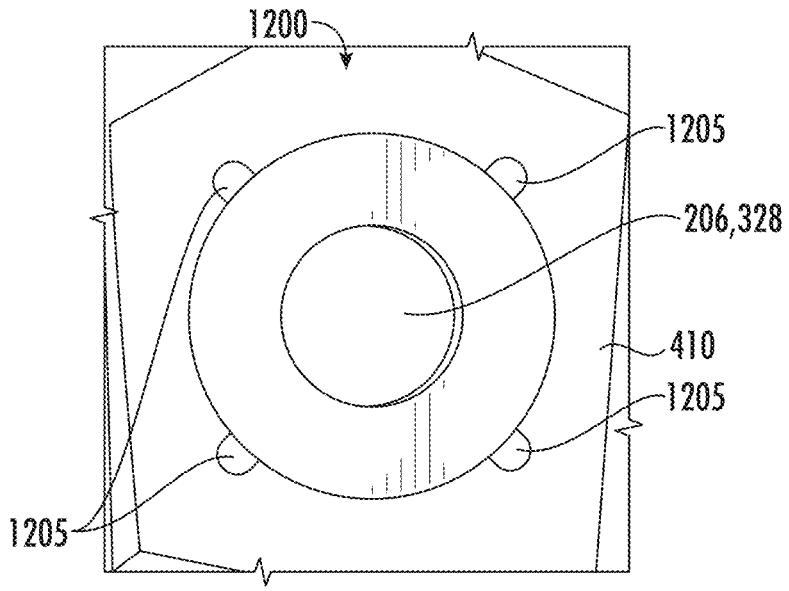
FIG. 14 is a top view of a plenum defined in an aft plate of the bundled tube fuel nozzle assembly of FIG. 11B, in accordance with embodiments of the present disclosure.

FIG. 14 illustrates a plan view of the plenum 1200 defined in the aft plate 312 of the bundled tube fuel nozzle assembly 1110 of FIG. 11B, in accordance with embodiments of the present disclosure. More specifically, FIG. 14 illustrates a plan view of the upstream face 410 (i.e., as viewed from between the downstream face 405 and the aft surface of the upstream face 410).

In at least one example embodiment, the plurality of cooling channels 1205 may be equidistantly disposed about each of the pre-mix flow passages 328 of the plurality of premix tubes 206. For example, as shown in FIG. 14, the bundled tube fuel nozzle assembly 1110 may include four of the plurality of cooling channels 1205 may be equidistantly disposed about each of the pre-mix flow passages 328 of the plurality of premix tubes 206. In other example embodiments, the bundled tube fuel nozzle assembly 1100, 1110 may include one or more of the plurality of cooling channels 1205 disposed adjacent to and/or surrounding the pre-mix flow passages 328 of the plurality of premix tubes 206. In still other example embodiments, the plurality of cooling channels 1205 may be unequally spaced about the pre-mix flow passage 328 of the plurality of premix tubes 206.

Figure 15:
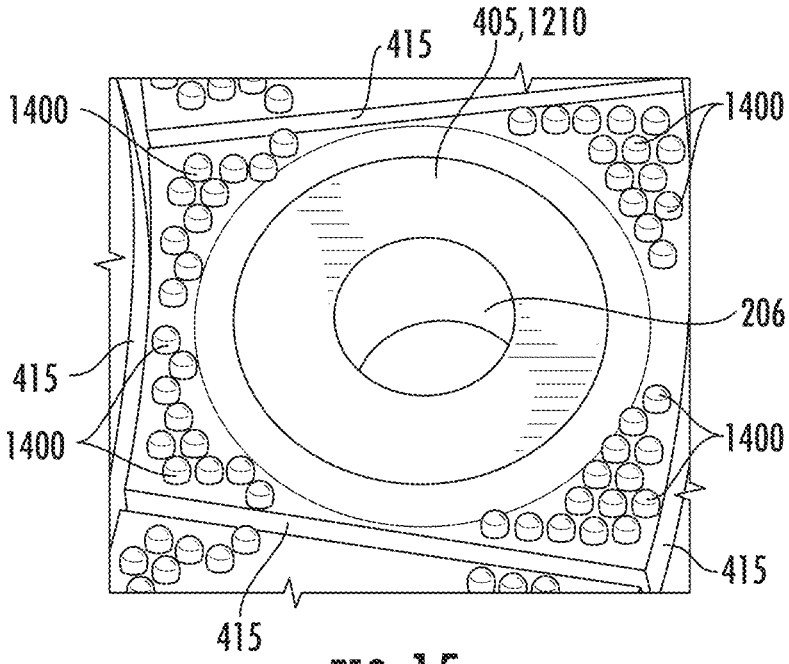
FIG. 15 is a view of an inner surface of a downstream face of the aft plate of the bundled tube fuel nozzle assembly of FIG. 11B, in accordance with embodiments of the present disclosure.

FIG. 15 illustrates a view of the inner surface 1210 of one of the tiles 420 of the downstream face 405 of the aft plate 312 of the bundled tube fuel nozzle assembly 1110 of FIG. 11B, in accordance with embodiments of the present disclosure.

In at least one example embodiment, the bundled tube fuel nozzle assembly 1110 includes a plurality of protrusions 1400 extending from the inner surface 1210 of the downstream face 405 towards the upstream face 410. The protrusions 1400 are configured to transfer heat between the downstream face 405 of the aft plate 312 and the cooling airflow flowing through the plurality of cooling channels 1205, the plenum 1200, and the plurality of peripheral openings 415. Moreover, the plurality of protrusions 1400 may create a tortuous pathway for the cooling airflow. In some example embodiments, the plurality of protrusions 1400 have a cylindrical shape, a conical shape, a round (e.g., hemispherical) shape, an oval shape, a rectangular shape, or a combination thereof. However, it should also be understood that the plurality of protrusions 1400 may have any polygonal shape.

While FIGS. 14 and 15 illustrate a portion of the downstream face 405 having an annular sector shape as shown in the bundled tube fuel nozzle assembly 1110 of FIG. 11B, it should be understood that features shown in FIGS. 14 and 15 may be used with premixing tubes 206 and aft plates 312 having tiles 420 of any shape, size, or configuration.

Figure 16:
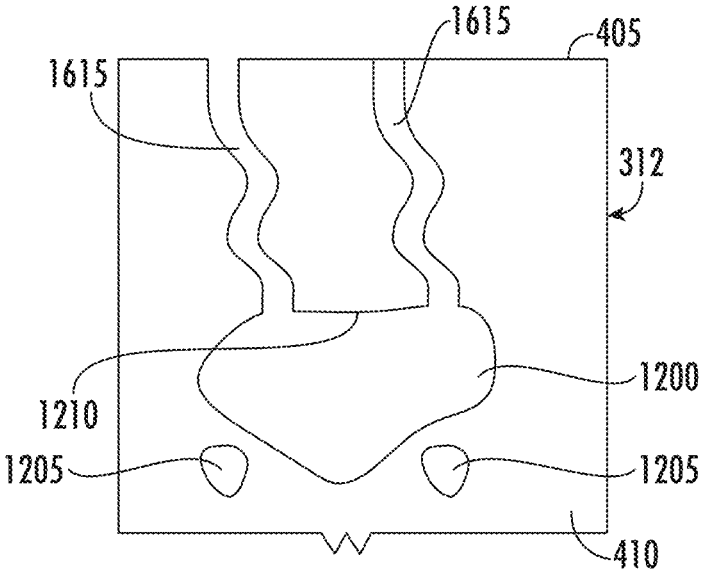
FIG. 16 is a detailed, cross-sectional view of a plenum defined in the aft plate of the bundled tube fuel nozzle assembly of FIGS. 11A-11B, in accordance with embodiments of the present disclosure.

FIG. 16 illustrates a detailed, cross-sectional view of the plenum 1200 defined in the aft plate 312 of the bundled tube fuel nozzle assembly 1100, 1110 of FIGS. 11A-11B, in accordance with embodiments of the present disclosure.

In at least one example embodiment, a plurality of peripheral openings 1615 are defined between adjacent tiles 420 in the downstream face 405 of the aft plate 312 and in fluid communication with the plenum 1200. The plurality of peripheral openings 1615 may be similar or analogous to the plurality of peripheral openings 415 described with respect to FIGS. 4A-15. Moreover, the plurality of peripheral openings 1615 may be incorporated into the embodiments discussed with respect to FIGS. 4A-15 as the plurality of peripheral openings 415.

In at least one example embodiment, the plurality of peripheral openings 1615 include at least one directional change. For example, the plurality of peripheral openings 1615 define a tortuous fluid pathway from the plenum 1200 and out of the downstream face 405 of the aft plate 312. For example, the plurality of peripheral openings 1615 may include a curved fluid pathway having one or more turns, as shown in FIG. 16.

Figure 17:
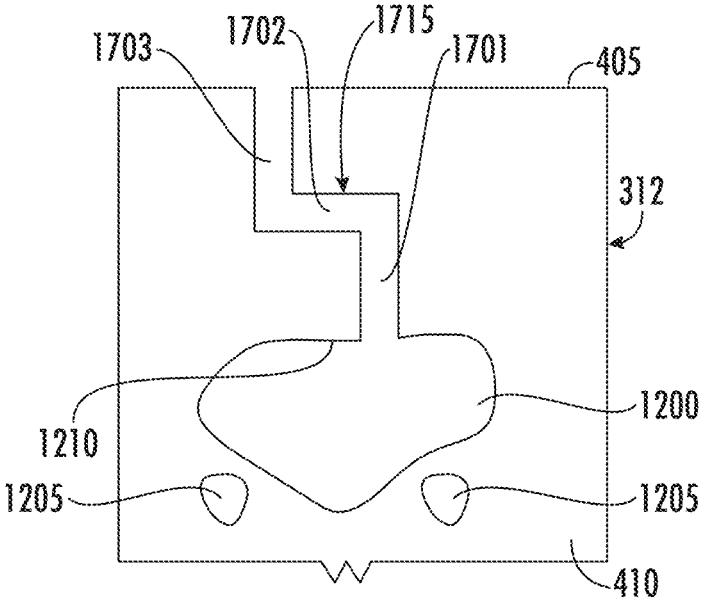
FIG. 17 is a detailed, cross-sectional view of a plenum defined in the aft plate of the bundled tube fuel nozzle assembly of FIGS. 11A-11B, in accordance with embodiments of the present disclosure.

FIG. 17 illustrates a detailed, cross-sectional view of the plenum 1200 defined in the aft plate 312 of the bundled tube fuel nozzle assembly 1100, 1110 of FIGS. 11A-11B, in accordance with embodiments of the present disclosure.

In at least one example embodiment, a plurality of peripheral openings 1715 are defined between adjacent tiles 420 in the downstream face 405 of the aft plate 312 and in fluid communication with the plenum 1200. The plurality of peripheral openings 1715 may be similar or analogous to the plurality of peripheral openings 415 described with respect to FIGS. 4A-15. Moreover, the plurality of peripheral openings 1715 may be incorporated into the embodiments discussed above with respect to FIGS. 4A-15 as the plurality of peripheral openings 415.

In at least one example embodiment, the plurality of peripheral openings 1715 includes at least one directional change. For example, the plurality of peripheral openings 1715 define fluid passageways having a step portion between the plenum 1200 and the downstream face 405 of the aft plate 312. For example, the plurality of peripheral openings 1715 may include a first pathway portion 1701, a second pathway portion 1702, and a third pathway portion 1703. The second pathway portion 1702 is between the first pathway portion 1701 and the third pathway portion 1703. The first pathway portion 1701 extends from the plenum 1200 normal or perpendicular to the upstream face 410 and the downstream face 405 of the aft plate 312. The second pathway portion 1702 extends perpendicularly between the first pathway portion 1701 and the third pathway portion 1703. The third pathway portion 1703 extends perpendicularly from the second pathway portion 1702 to the downstream face 405 such that the third pathway portion 1703 is normal or perpendicular to the upstream face 410 and the downstream face 405 of the aft plate 312. Accordingly, the plurality of peripheral openings 1715 define a tortuous pathway from the plenum 1200 to the downstream face 405 of the aft plate 312.

The bundled tube fuel nozzles described herein may be efficiently built using additive manufacturing techniques, including direct metal laser melting (DMLM) and direct metal laser sintering (DMLS) in which metallic powder is melted or sintered using a laser or other energy source in a layer-by-layer fashion until the desired geometry of the component is achieved. Such additive manufacturing permits the development of complex internal and external shapes that would be otherwise difficult to produce using conventional manufacturing processes (such as casting). For example, the forward plate 304, the divider plate 306, the sidewall 308 (FIG. 3), the premixing tubes 206, and the aft plate 312 with its continuous upstream face 410 and segmented downstream face 405 may be printed as a unitary structure, thereby eliminating the need for multiple braze or weld joints where the premixing tubes 206 pass through the plates 304, 306, 312. Desirable features (including, e.g., the inlet passages 320, the annular impingement portion 500, and the impingement passages 515) and optional features (including, e.g., cooling channels 1205, heat-transfer protrusions 1400, tortuous peripheral openings 1615, and stepped peripheral openings 1715) may also be incorporated into the additively manufactured structure without the need for expensive post-processing steps to define such features. One or more bundled tube fuel nozzles may be printed in such a manner to function as fuel nozzles 40 described herein.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A bundled tube fuel nozzle, comprising: a body defining a fuel plenum and including a forward plate at least partially defining the fuel plenum; a plurality of tubes extending axially through the fuel plenum, each tube of the plurality of tubes having an inlet defined through the forward plate; and an aft plate axially spaced from the forward plate, the aft plate comprising a downstream face having a plurality of tiles, wherein each tile of the plurality of tiles extends radially outward from one or more tubes of the plurality of tubes, the aft plate defining a plurality of peripheral openings between the plurality of tiles to permit a cooling flow therethrough from an upstream side of the aft plate to a downstream side of the aft plate.

The bundled tube fuel nozzle of any previous clause, wherein: each of the plurality of tiles is shaped as a polygon having three or more sides; and each of the plurality of peripheral openings is shaped as a polygon having three or more sides.

The bundled tube fuel nozzle of any previous clause, wherein the aft plate further comprises an upstream face and an annular impingement portion disposed between the upstream face and the downstream face.

The bundled tube fuel nozzle of any previous clause, wherein: the annular impingement portion defines a first plenum; the aft plate defines a second plenum between the annular impingement portion and the downstream face; and the annular impingement portion defines at least one impingement passage extending from the first plenum towards the downstream face, the at least one impingement passage configured to direct a fluid upon an inner surface of the downstream face.

The bundled tube fuel nozzle of any previous clause, wherein: the upstream face defines at least one inlet passage in fluid communication with the first plenum; and the plurality of peripheral openings is in fluid communication with the second plenum.

The bundled tube fuel nozzle of any previous clause, wherein the at least one impingement passage is angled relative to a vertical axis extending between the forward plate and the aft plate.

The bundled tube fuel nozzle of any previous clause, wherein: the annular impingement portion comprises an air plenum surrounding each of the plurality of tubes; and the bundled tube fuel nozzle further comprises a plurality of cooling channels in fluid communication with the air plenum, the plurality of cooling channels extending along a length of the plurality of tubes perpendicularly to the forward plate and the aft plate.

The bundled tube fuel nozzle of any previous clause, wherein one or more tiles of the plurality of tiles extends radially outward from two or more of the plurality of tubes.

The bundled tube fuel nozzle of any previous clause, further comprising a plurality of protrusions extending from an inner surface of the downstream face of one or more tiles of the aft plate, the plurality of protrusions configured to transfer heat between the cooling flow and the downstream face of the aft plate.

The bundled tube fuel nozzle of any previous clause, wherein a flow path defined by the plurality of peripheral openings between the plurality of tiles has a constant diameter in a direction of the flow path.

The bundled tube fuel nozzle of any previous clause, wherein a flow path defined by the plurality of peripheral openings between the plurality of tiles includes at least one directional change.

A combustor for a gas turbine engine, comprising: a bundled tube fuel nozzle, comprising: a body defining a fuel plenum and including a forward plate and an aft plate at least partially defining the fuel plenum; a plurality of tubes extending axially through the fuel plenum, each tube of the plurality of tubes having an inlet defined through the forward plate; and an air plenum downstream of the fuel plenum, the air plenum at least partially defined between an upstream face and a downstream face of the aft plate; wherein the downstream face of the aft plate comprises a plurality of tiles, each tile of the plurality of tiles extending radially outward from one or more tubes of the plurality of tubes, the aft plate defining a plurality of peripheral openings between the plurality of tiles to permit a cooling flow therethrough from an upstream face of the aft plate to a downstream face of the aft plate; and wherein the cooling flow is directed onto an inner surface of the downstream face of the aft plate and through the plurality of peripheral openings.

The combustor of any previous clause, wherein: each of the plurality of tiles in the downstream face is shaped as a polygon having three or more sides; and each of the plurality of peripheral openings is shaped as a polygon having three or more sides.

The combustor of any previous clause, wherein at least one side of the plurality of peripheral openings is in fluid communication with at least one side of an adjacent one of the plurality of peripheral openings.

The combustor of any previous clause, wherein the aft plate further comprises an annular impingement portion disposed between the upstream face and the downstream face, the annular impingement portion defining the air plenum.

The combustor of any previous clause, wherein: the air plenum comprises a first plenum; the aft plate defines a second plenum between the annular impingement portion and the downstream face; and the annular impingement portion defines at least one impingement passage extending from the first plenum towards the downstream face, the at least one impingement passage configured to direct a fluid upon an inner surface of the downstream face.

The combustor of any previous clause, wherein: the upstream face defines at least one inlet passage in fluid communication with the first plenum; and the plurality of peripheral openings is in fluid communication with the second plenum.

The combustor of any previous clause, wherein the at least one impingement passage is angled relative to a vertical axis extending between the forward plate and the aft plate.

The combustor of any previous clause, wherein one or more tiles of the plurality of tiles extends radially outward from two or more of the plurality of tubes.

The combustor of any previous clause, wherein: the air plenum surrounds each of the plurality of tubes; and the bundled tube fuel nozzle further comprises a plurality of cooling channels in fluid communication with the air plenum, the plurality of cooling channels extending along a length of the plurality of tubes perpendicularly to the aft plate and the forward plate.

The combustor of any previous clause, further comprising a plurality of protrusions disposed in the air plenum extending from an inner surface of the downstream face of the aft plate, the plurality of protrusions configured to transfer heat between the cooling flow and the downstream face of the aft plate.

What is claimed is:

1. A bundled tube fuel nozzle, comprising:

a body defining a fuel plenum and including a forward plate at least partially defining the fuel plenum;

a plurality of tubes extending axially through the fuel plenum, each tube of the plurality of tubes having an inlet defined through the forward plate; and an aft plate axially spaced from the forward plate, the aft plate comprising a downstream face having a plurality of tiles, wherein each tile of the plurality of tiles extends radially outward from one or more tubes of the plurality of tubes, the aft plate defining a plurality of peripheral openings between the plurality of tiles to permit a cooling flow therethrough from an upstream side of the aft plate to a downstream side of the aft plate.

2. The bundled tube fuel nozzle of claim 1, wherein:

each of the plurality of tiles is shaped as a polygon having three or more sides; and each of the plurality of peripheral openings is shaped as a polygon having three or more sides.

3. The bundled tube fuel nozzle of claim 1, wherein the aft plate further comprises an upstream face and an annular impingement portion disposed between the upstream face and the downstream face.

4. The bundled tube fuel nozzle of claim 3, wherein:

the annular impingement portion defines a first plenum;

the aft plate defines a second plenum between the annular impingement portion and the downstream face; and the annular impingement portion defines at least one impingement passage extending from the first plenum towards the downstream face, the at least one impingement passage configured to direct a fluid upon an inner surface of the downstream face.

5. The bundled tube fuel nozzle of claim 4, wherein:

the upstream face defines at least one inlet passage in fluid communication with the first plenum; and the plurality of peripheral openings is in fluid communication with the second plenum.

6. The bundled tube fuel nozzle of claim 4, wherein the at least one impingement passage is angled relative to a vertical axis extending between the forward plate and the aft plate.

7. The bundled tube fuel nozzle of claim 3, wherein:

the annular impingement portion comprises an air plenum surrounding each of the plurality of tubes; and the bundled tube fuel nozzle further comprises a plurality of cooling channels in fluid communication with the air plenum, the plurality of cooling channels extending along a length of the plurality of tubes perpendicularly to the forward plate and the aft plate.

8. The bundled tube fuel nozzle of claim 1, wherein one or more tiles of the plurality of tiles extends radially outward from two or more of the plurality of tubes.

9. The bundled tube fuel nozzle of claim 1, further comprising a plurality of protrusions extending from an inner surface of the downstream face of one or more tiles of the aft plate, the plurality of protrusions configured to transfer heat between the cooling flow and the downstream face of the aft plate.

10. The bundled tube fuel nozzle of claim 1, wherein a flow path defined by the plurality of peripheral openings between the plurality of tiles has a constant diameter in a direction of the flow path.

11. The bundled tube fuel nozzle of claim 1, wherein a flow path defined by the plurality of peripheral openings between the plurality of tiles includes at least one directional change.

12. A combustor for a gas turbine engine, comprising:

a bundled tube fuel nozzle, comprising:

a body defining a fuel plenum and including a forward plate and an aft plate at least partially defining the fuel plenum;

a plurality of tubes extending axially through the fuel plenum, each tube of the plurality of tubes having an inlet defined through the forward plate; and an air plenum downstream of the fuel plenum, the air plenum at least partially defined between an upstream face and a downstream face of the aft plate;

wherein the downstream face of the aft plate comprises a plurality of tiles, each tile of the plurality of tiles extending radially outward from one or more tubes of the plurality of tubes, the aft plate defining a plurality of peripheral openings between the plurality of tiles to permit a cooling flow therethrough from an upstream face of the aft plate to a downstream face of the aft plate; and wherein the cooling flow is directed onto an inner surface of the downstream face of the aft plate and through the plurality of peripheral openings.

13. The combustor of claim 12, wherein:

each of the plurality of tiles in the downstream face is shaped as a polygon having three or more sides;

each of the plurality of peripheral openings is shaped as a polygon having three or more sides; and at least one side of the plurality of peripheral openings is in fluid communication with at least one side of an adjacent one of the plurality of peripheral openings.

14. The combustor of claim 12, wherein the aft plate further comprises an annular impingement portion disposed between the upstream face and the downstream face, the annular impingement portion defining the air plenum.

15. The combustor of claim 14, wherein:

the air plenum comprises a first plenum;

the aft plate defines a second plenum between the annular impingement portion and the downstream face; and the annular impingement portion defines at least one impingement passage extending from the first plenum towards the downstream face, the at least one impingement passage configured to direct a fluid upon an inner surface of the downstream face.

16. The combustor of claim 15, wherein:

the upstream face defines at least one inlet passage in fluid communication with the first plenum; and the plurality of peripheral openings is in fluid communication with the second plenum.

17. The combustor of claim 15, wherein the at least one impingement passage is angled relative to a vertical axis extending between the forward plate and the aft plate.

18. The combustor of claim 12, wherein one or more tiles of the plurality of tiles extends radially outward from two or more of the plurality of tubes.

19. The combustor of claim 12, wherein:

the air plenum surrounds each of the plurality of tubes; and the bundled tube fuel nozzle further comprises a plurality of cooling channels in fluid communication with the air plenum, the plurality of cooling channels extending along a length of the plurality of tubes perpendicularly to the aft plate and the forward plate.

20. The combustor of claim 12, further comprising a plurality of protrusions disposed in the air plenum extending from an inner surface of the downstream face of the aft plate, the plurality of protrusions configured to transfer heat between the cooling flow and the downstream face of the aft plate.

* * * * *